United States Patent [19]

Ishigaki et al.

[11] Patent Number: 5,057,867

[45] Date of Patent: Oct. 15, 1991

[54] IMAGE FORMING APPARATUS WHICH CORRECTS THE IMAGE FORMING FACTORS IN RESPONSE TO DENSITY SENSING MEANS AND DURATION OF INACTIVE STATE

[75] Inventors: Kouji Ishigaki, Yokohama; Yasuji Takagi, Matsudo, both of Japan

[73] Assignee: Ricoh Company, Ltd., Tokyo, Japan

[21] Appl. No.: 416,989

[22] Filed: Oct. 4, 1989

[30] Foreign Application Priority Data

Oct. 5, 1988 [JP] Japan ..... 63-249897

[51] Int. Cl.[5] ..... G03G 15/00

[52] U.S. Cl. ..... 355/208; 355/214; 355/246

[58] Field of Search ..... 355/208, 219, 228, 246, 355/203, 207, 204, 214, 285

[56] References Cited

U.S. PATENT DOCUMENTS 4,564,287 1/1986 Suzuki et al. ..... 355/208
4,583,835 4/1986 Harada ..... 355/214
4,797,707 1/1989 Iwahashi et al. ..... 355/208
4,855,766 8/1989 Suzuki ..... 355/208 X
4,982,232 1/1991 Naito ..... 355/208

*Primary Examiner*—Joan H. Pendegrass
*Assistant Examiner*—Christopher Horgan
*Attorney, Agent, or Firm*—Oblon, Spivak, McClelland, Maier & Neustadt

[57] ABSTRACT

An electrophotographic copier, facsimile machine, laser printer or similar image forming apparatus having a photoconductive element. The apparatus corrects a bias voltage for development, amount of charge, amount of exposure or similar image forming factor on the basis of an inactive state of the photoconductive element. When the duration of the inactive state is short and does not need a correction of the image forming factor, an image forming procedure is executed immediately. When the inactive state has lasted a long time, the image forming factor is corrected before the start of an image forming procedure.

6 Claims, 37 Drawing Sheets

Fig. 2A

PRIOR ART

10°C~20°C (SURFACE TEMP. OF PHOTOCONDUCTIVE ELEMENT)

| NUMBER OF COPIES / SUSPENSION TIME OF PHOTO-CONDUCTIVE ELEMENT | 1 | 2 | 3 | 4 . 5 | 6 ~ 10 |
|---|---|---|---|---|---|
| 0 SEC TO 10 SEC (UNDER) | continuation of previous condition | | | | |
| 10 SEC TO 3 MIN | | | | | |
| 3 MIN TO 50 MIN | + 30 | + 30 | 0 | 0 | 0 |
| 50 MIN TO 2 HR | + 30 | + 30 | + 30 | 0 | 0 |
| MORE THAN 2 HR | + 60 | + 30 | + 30 | + 30 | 0 |

Fig. 2B

PRIOR ART

20°C ~ 40°C (SURFACE TEMP. OF PHOTOCONDUCTIVE ELEMENT)

| NUMBER OF COPIES / SUSPENSION TIME OF PHOTO-CONDUCTIVE ELEMENT | 1 | 2 | 3 | 4 . 5 | 6 ~ 10 |
|---|---|---|---|---|---|
| 0 SEC TO 10 SEC (UNDER) | continuation of previous condition | | | | |
| 10 SEC TO 3 MIN | + 30 | + 30 | + 30 | 0 | 0 |
| 3 MIN TO 50 MIN | + 60 | + 60 | + 30 | + 30 | 0 |
| 50 MIN TO 2 HR | + 90 | + 60 | + 60 | + 30 | + 30 |
| MORE THAN 2 HR | + 120 | + 90 | + 90 | + 60 | + 30 |

Fig. 7

| FREQ. | 1 ST | 2 ND | 3 RD | 4 TH | 5 TH | 6 TH | MEAN OF 1~6 |
|---|---|---|---|---|---|---|---|
| ① | 3.63 | 4.14 | 4.02 | 3.41 | 3.57 | 4.04 | |
| ② | 3.70 | 4.20 | 4.00 | 3.49 | 3.63 | 3.94 | |
| ③ | 4.02 | 3.88 | 3.84 | 3.75 | 3.84 | 3.67 | |
| ④ | 4.23 | 3.71 | 3.69 | 3.98 | 4.24 | 3.80 | |
| ⑤ | 4.08 | 3.76 | 3.63 | 4.10 | 4.12 | 3.94 | |
| ⑥ | 3.76 | 3.92 | 3.84 | 3.75 | 3.78 | 4.02 | |
| ①~⑥ (MEAN) | 3.90 | 3.94 | 3.84 | 3.75 | 3.86 | 3.90 | $\bar{x}$ =3.865 |
| | | | | | | | =0.07 |

PW001
BIAS UP-DOWN FLAG SET ?
S17
YES
NO
DETECTION START FLAG SET ?
S18
NO
YES
VSG READ FLAG SET ?
S19
NO
YES
TO ORDINARY COPY WAIT PROCESSING
S20
RESET DETECTION START FLAG
S20
RESET CONTAMINATION CHECK END FLAG
S21
SET UNDER CONTAMINATION CHECK FLAG
S22

Fig. 23

| NO. | ITEM | DATA ASSOCIATED WITH PW051~6 | | | | | |
|---|---|---|---|---|---|---|---|
| | | 0° | 60° | 120° | 180° | 240° | 300° |
| *1 | DRUM PULSE COUNTER LOWER LIMIT | 219 | 259 | 299 | 339 | 379 | 419 |
| *2 | DRUM PULSE COUNTER UPPER LIMIT | 232 | 272 | 312 | 352 | 392 | 432 |
| *3 | WHICH PROCESSING IN FREQUENCY | 00H | 01H | 02H | 03H | 04H | 05H |
| *4 | ADDRESS OF OUTPUT DATA | DPSTL1 (0C199H) | DPSTL2 (A) | DPSTL3 (B) | DPSTL4 (C) | DPSTL5 (D) | DPSTL6 (0C19EH) |
| *5 | FLAG FOR NEXT READING | 01H | 02H | 03H | 04H | 05H | (00H) |

| | |
|---|---|
| Fig. 28A | |
| Fig. 28B | Fig. 28C |

| Fig. 32A |
| --- |
| Fig. 32B |

IMAGE FORMING APPARATUS WHICH CORRECTS THE IMAGE FORMING FACTORS IN RESPONSE TO DENSITY SENSING MEANS AND DURATION OF INACTIVE STATE

BACKGROUND OF THE INVENTION

The present invention relates to an image forming apparatus of the type using all electrophotographic procedure and, more particularly, to an image forming apparatus capable of producing a stable and clear-cut image at all times.

A prerequisite for an electrophotographic copier, facsimile machine, laser printer or similar image forming apparatus is that it produces an image with stable density and clear-cutness over a long period of time. An electrophotographic copier, for example, has a photoconductive element which is implemented by OPC or selenium-based organic semiconductor. A photoconductive element using OPC in particular has a problem that a surface potential thereof, especially in a comparatively low potential area, is susceptible to a change in surface temperature and deterioration. Hence, an electrophotographic copier with an OPC photoconductive element causes the background of a reproduction to be blurred or an image to be lost after a long time of use, even though it may be provided with an expedient for controlling toner density.

SUMMARY OF THE INVENTION

It is therefore an object of the present invention to provide an image forming apparatus which produces images with stable density and clear-cutness despite a long time of use by correcting an image forming factor on the basis of the duration of an inactive state of the apparatus.

It is another object of the present invention to provide a generally improved image forming apparatus.

An image forming apparatus having an image carrier for carrying a latent image of the present invention comprises a state sensor for sensing an inactive state of the image carrier, a density sensor for sensing a density of a predetermined density sensing portion of the image carrier, and a controller for correcting an image forming factor in response to an output signal of the state sensor and an output signal of the density sensor which are representative of a sensed inactive state and a sensed density, respectively.

BRIEF DESCRIPTION OF THE DRAWINGS

The above and other objects, features and advantages of the present invention will become more apparent from the following detailed description taken with the accompanying drawings in which:

FIGS. 2A and 2B are tables representative of a method heretofore adopted to correct the surface potential of a photoconductive element;

FIG. 7 is a table showing how the background density of a photoconductive element of the illustrative embodiment is read;

FIG. 23 is a table listing data which are processed by the procedure shown in FIG. 22.

DESCRIPTION OF THE PREFERRED EMBODIMENT

To better understand the present invention, how the surface potential of a photoconductive element installed in an image forming apparatus changes will be described. Let the image forming apparatus be an electrophotographic copier by way of example.

Figure 1:
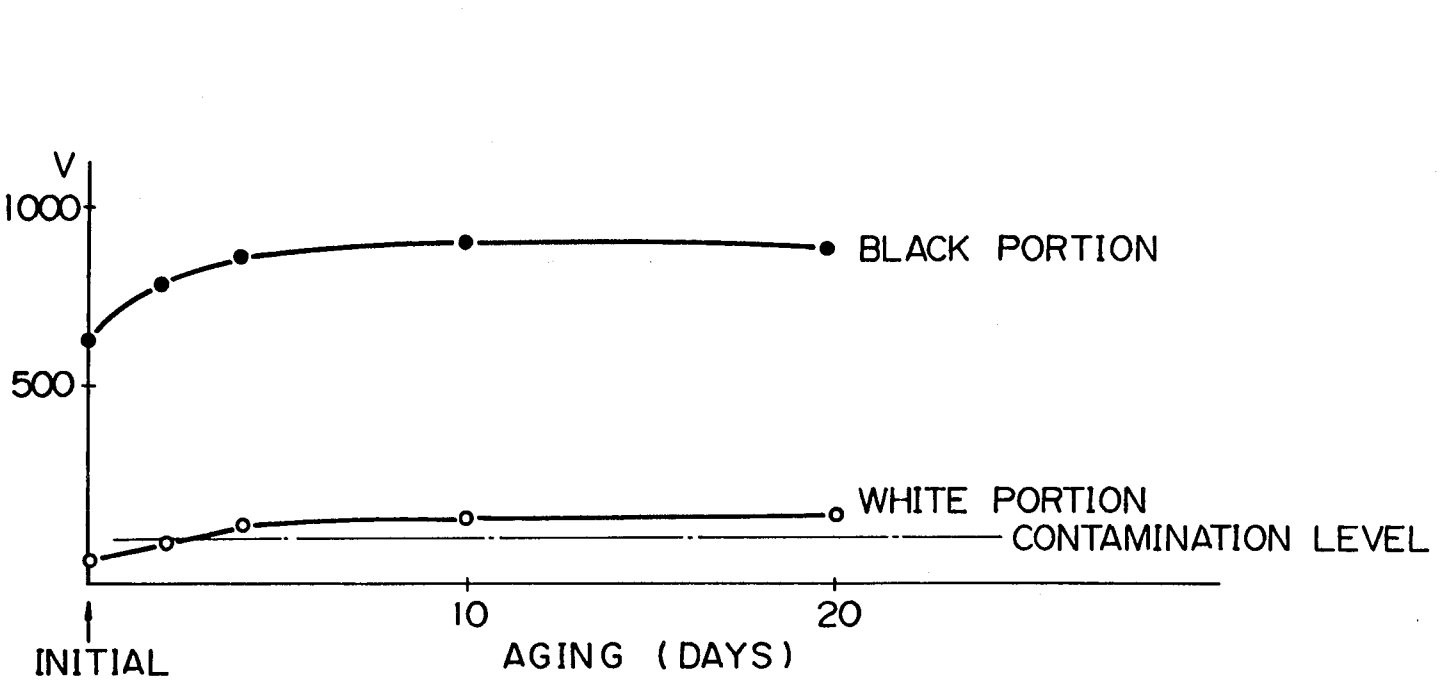
FIG. 1 is a chart showing the variation of a potential of a photoconductive element due to aging.

As shown in FIG. 1, the surface potential, whether it be associated with a black portion or a white portion, differs by about 100 volts from the initial state to the aged state, constituting a cause of background contamination. This has customarily been coped with by maintenance which is performed either periodically or in response to a user's demand.

On the other hand, with this kind of copier, it is a common practice to correct an image forming factor such as a bias voltage for development in association with the surface temperature of a photoconductive element, the number of copies produced and the duration of an inactive state of the machine which are measured on a minutes basis or an hours basis. FIGS. 2A and 2B show a conventional method of correcting a bias voltage for development in association with the surface temperature of a photoconductive element, the number of copies produced and the duration of an inactive state, as stated above. Specifically, when the surface temperature lies in the range of 10° C. to 20° C., the bias voltage is corrected on the basis of the duration of an inactive state in the manner shown in FIG. 2A. When the surface temperature lies in the range of 20° C. to 40° C., the bias voltage is corrected as shown in FIG. 2B. Further, when the surface temperature is lower than 10° C., the bias voltage is not corrected at all. Another method known in the art uses a surface temperature of 30° C. for a reference and corrects a reference bias voltage for development by a ratio of 14 volts per 1° C. when the temperature is 5° C. to 15° C. and by a ratio of 6 volts per 1° C. when the temperature is 15° C. to 50° C. Japanese Patent Laid-Open Publication No. 62-209569 proposes another implementation which uses a first and a second reference latent image which are formed in an area of a photoconductive element remote from an image forming area, the second reference latent image being lower in document density than the first reference latent image. Specifically, the supply of a toner is controlled in response to a sensed density of a toner image associated with the first latent image, while the bias voltage for development is corrected in response to a sensed density of a toner image associated with the second latent image.

A problem with the prior art approach shown in FIGS. 2A and 2B is that it does not work sufficiently when an inactive state lasts some days, i.e., it copes only with suspensions of minutes and hours at most. The method using the ratios of 14 volts per 1° C. and 6 volts per 1° C. for the temperature ranges of 5° C. to 15° C. and 15° C. to 50° C. as stated previously is not satisfactory when it comes to such a long duration of an inactive state also, because the reference bias voltage for development itself will then become inadequate. In the procedure taught in Laid-Open Publication No. 62-209569, the first and second latent images are developed, the densities of the two images are sensed, and the reference bias voltage for development is corrected, every time a copying operation is performed. More specifically, even when the copier is restarted after a short time of suspension (e.g. 5 seconds) which does not need any correction in practice, the first and second latent images are formed and their densities are measured. This results in wasteful consumption of parts, toner, and power. While the reference bias may be corrected by using a surface potential sensor which constantly senses the surface potential of a photoconductive element, this shceme brings about another problem in the aspect of production cost.

Figure 3:
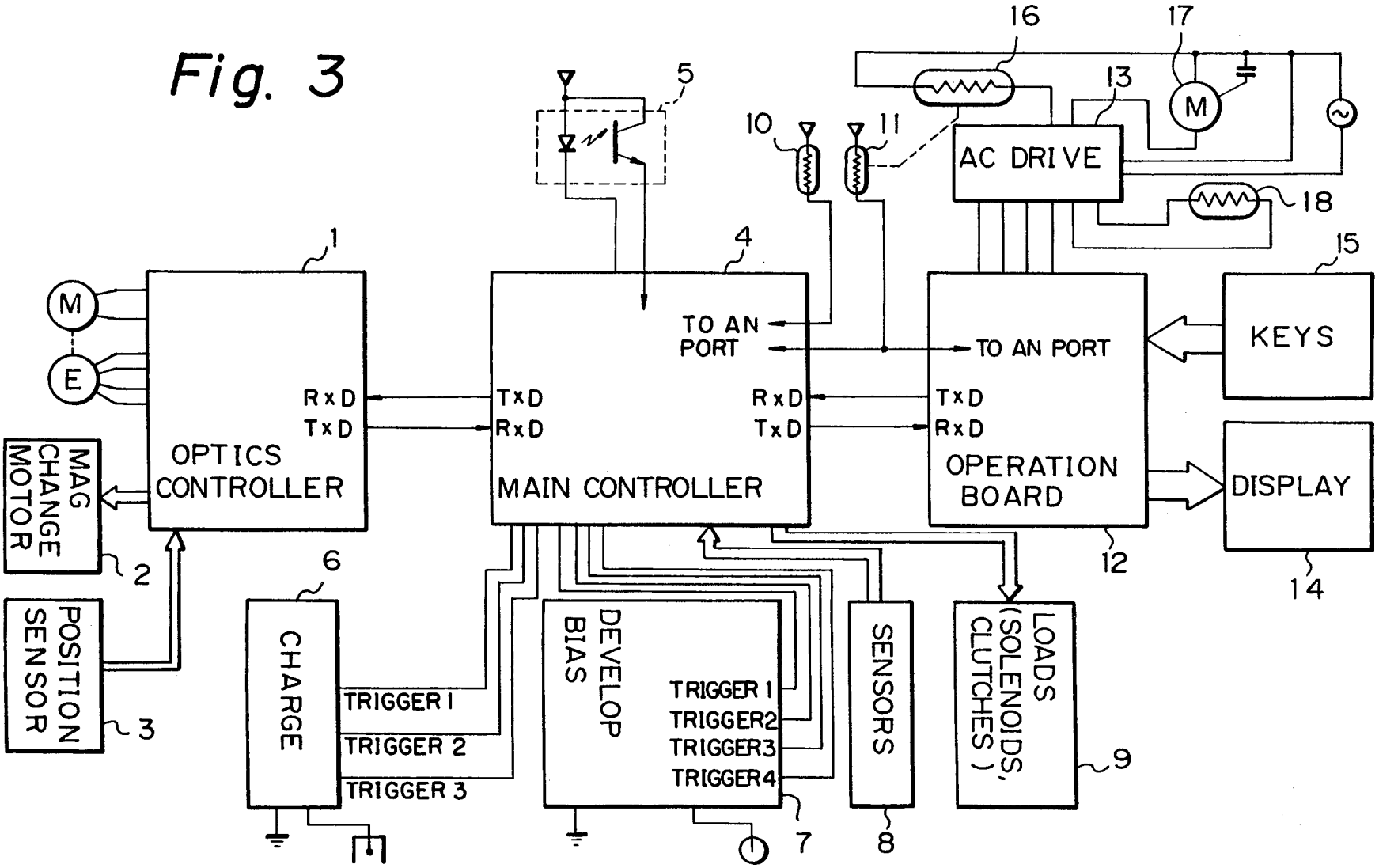
FIG. 3 is a schematic block diagram of an image forming apparatus embodying the present invention.

Referring to FIG. 3, an image forming apparatus embodying the present invention is shown in a schematic block diagram. There are shown in FIG. 3 an optics controller 1, a magnification changing motor 2, a position sensor 3, a main controller 4, a density sensor 5, a charging unit 6, various sensors 8, various loads 9, a drum thermistor 10, a fixation thermistor 11, an operation board 12, an AC driving unit 13, a display 14, keys 15, a heater 16, a main motor 17, and a lamp 18.

Figure 4:
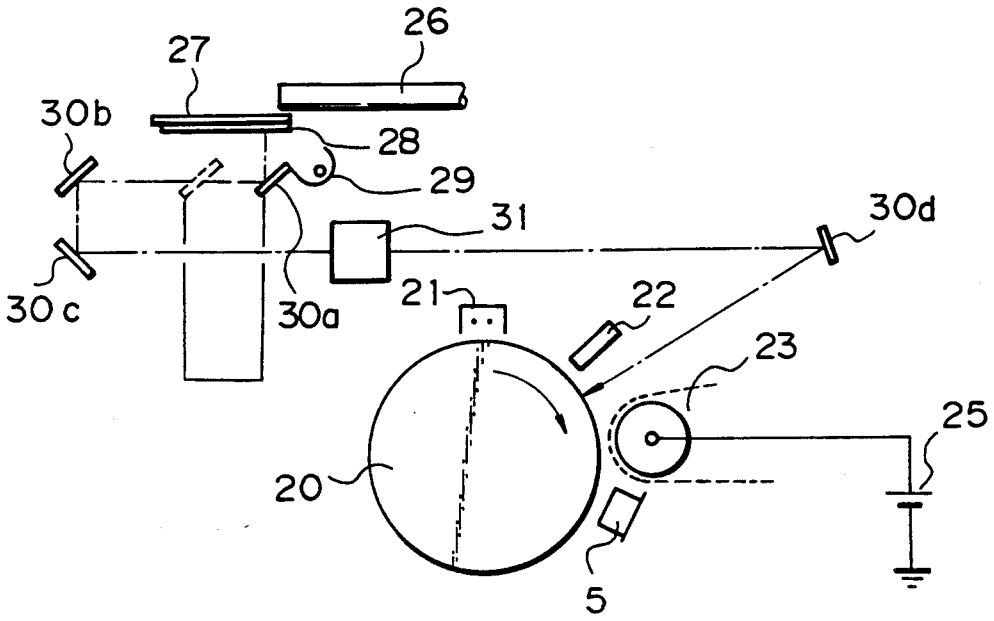
FIGS. 4 and 5 are respectively a schematic view and a front view each showing an essential part of the illustrative embodiment.

FIG. 4 shows the construction of an essential part of the illustrative embodiment. As shown, the construction includes a photoconductive element in the form of a drum 20, a charger 21, an eraser 22, a developing unit 23, the density sensor 5, a developing bias 25, a glass platen 26, a scale 27, a white reference pattern 28, a lamp 29, mirrors 30*a* to 30*d*, and a lens 31.

Figure 5:
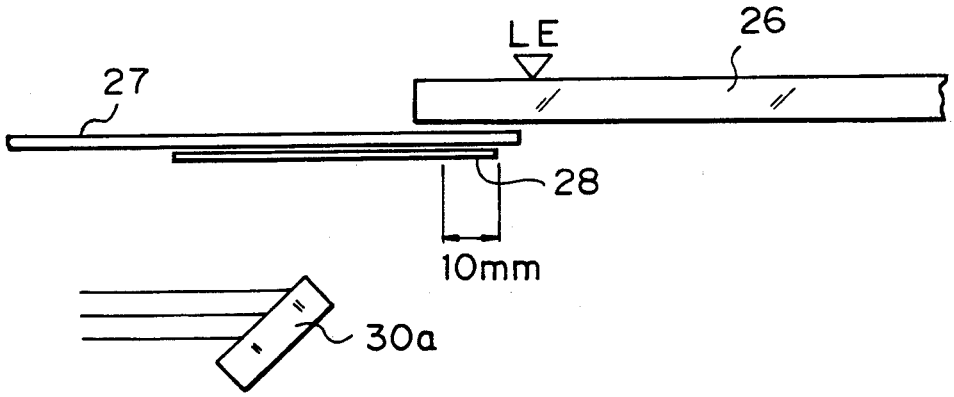

FIG. 5 is a front view of the white reference pattern 28 of FIG. 4 together with its associated parts and elements. The white reference pattern 28 is shown as extending over about 10 millimeters from the leading edge LE of the glass platen 26.

Figure 6:
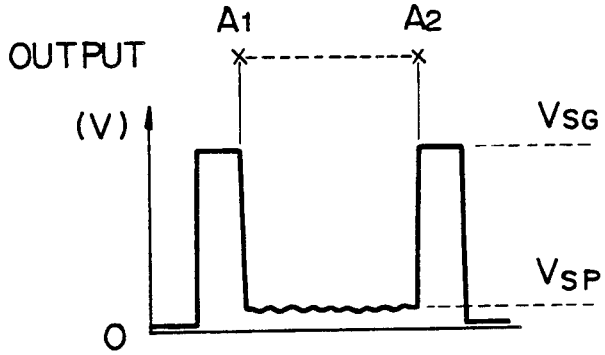
FIG. 6 is a graph showing outputs associated with a pattern portion of a photoconductive element and those associated with a background portion.

The density sensor 5 is made up of a light emitting element and a light-sensitive element which are implemented by an LED (Light Emitting Diode) and a phototransistor, respectively. Light issuing from the LED and then reflected by the drum 20 is incident to the light-sensitive element and photoelectrically converted. The control over toner density, toner-end detection and the like are effected in response to the result of photoelectric conversion. As shown in FIG. 6, the density sensor 5 reads not only a developed pattern portion $A_1$–$A_2$ but also the portions which precede and succeed it. Hence, both an output associated with the background of the drum 20 and an output associated with the pattern portion are read. Assume that the background output is VSG and the pattern output is VSP, as shown in FIG. 6. The toner density is determined on the basis of the ratio of VSG and VSP, i.e., the toner density is determined to be low (black toner little reflects light) when the output VSP is high. Then, toner supply control and toner-end detection are executed on the basis of VSG and VSP. In the illustrative embodiment, the pattern portion for correcting the reference bias voltage is implemented as a developed pattern of the white reference pattern 28. The reference bias voltage is corrected in response to outputs of the density sensor 5 which are individually associated with the developed pattern and the background of the drum 20.

The measurement of the background density of the drum 20 by the density sensor 5 is quite susceptible to the eccentricity of the drum 20 and the reflectance of the drum surface. In light of this, the illustrative embodiment divides the circumference of the drum 20 into equal parts, reads the densities of the individual parts, and then produces an output representative of a mean density. Specifically, as shown in FIG. 7, the circumference of the drum 20 is divided into six segments each 60 degrees, of each segment is read six consecutive times in synchronism with drum pulses, mean values of the individual segments are produced, and then an average of those average values is produced. Numerical values shown in FIG. 7 are representative of actually measured outputs. For the measurement, the output VSG associated with the background of the drum 20 was selected to be 4.0 volts, and the read start timing was random. By so reading outputs resulting from one full rotation of the drum 20, it is possible to reduce the influence of eccentricity. When VSG is read while the drum 20 is in rotation, an output representative of background contamination will be corrected in matching relation to VSG (ratio to VSG), enhancing accurate detection.

Since the density condition of a drum differs from one machine to another, a density sensor senses the developed white reference pattern density and the drum background density on a machine basis and, based on the sensed densities, a reference voltage for a developing unit is corrected machine by machine. Specifically, the pattern portion provided on the scale 27, FIG. 5, is different in optical path length from the document surface. This, coupled with the fact that the position of a filament of a lamp and/or the position of a reflector differs from one machine to another, causes the measured density to vary over a substantial range.

Figure 8A:
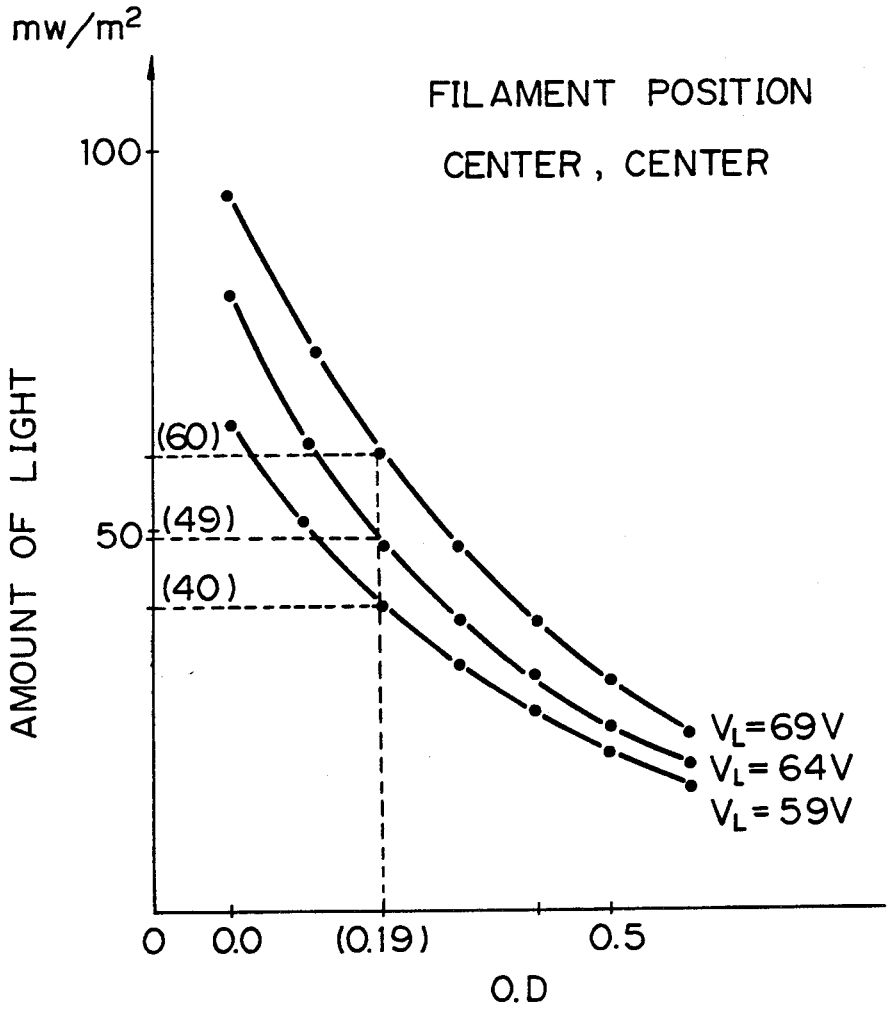
FIGS. 8A to 8C are graphs showing a relationship between the amount of light and the density with respect to various positions of a filament.
Figure 8B:
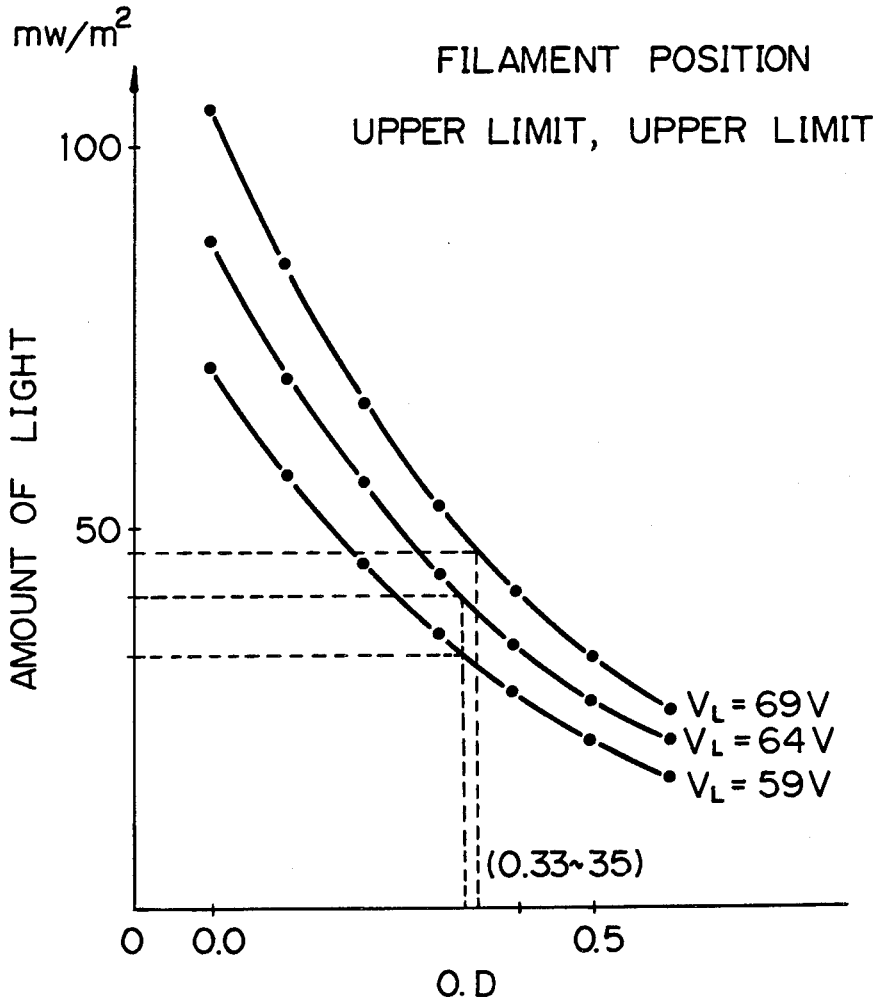
Figure 8C:
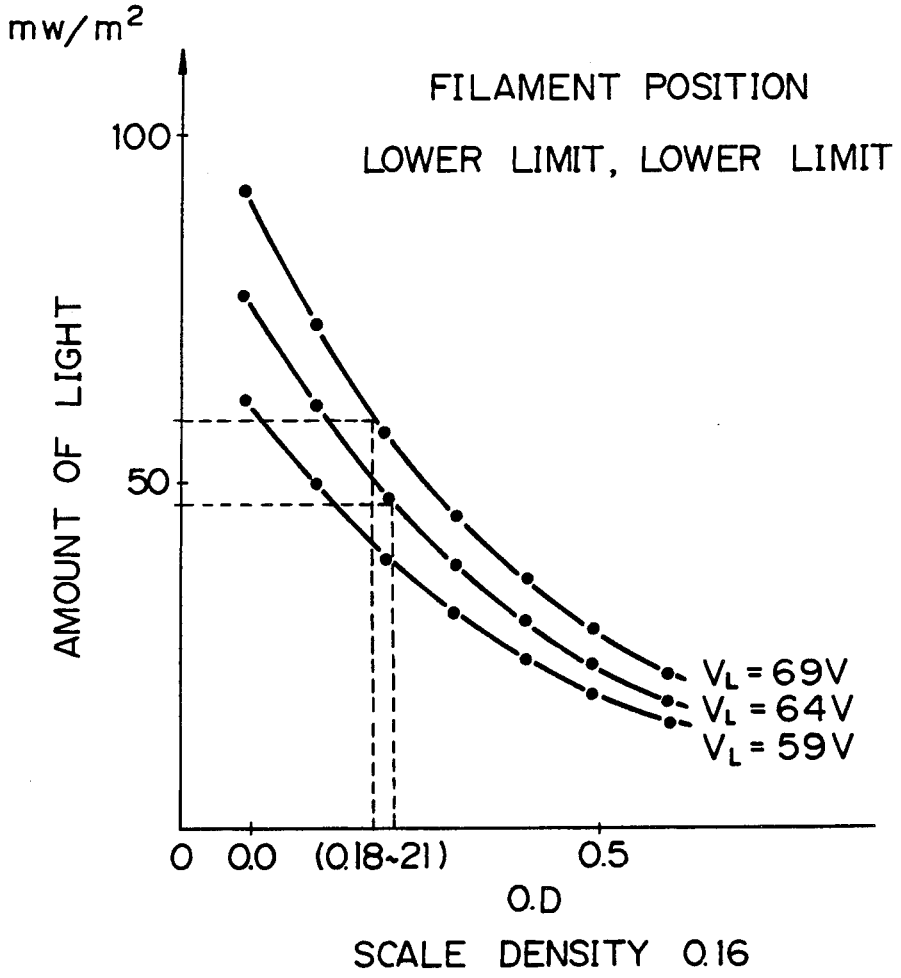

Referring to FIGS. 8A to 8C, there is shown a relationship between the density of the white reference pattern and the amount of light with respect to various positions of a filament and by using the potential VL of the white reference pattern image as a parameter. Experiments showed that the density of the white reference pattern image changes from OD 0.1 to a range of OD 0.18 to OD 0.35 (in terms of document surface). Specifically, the amount of exposure as measured on the drum surface changes by a substantial amount even if the combination of an amount of exposure (lamp voltage) and a reference pattern is maintained the same. For this reason, the reference value (initial reference data) has to be set machine by machine. The difference in the amount of exposure between machines can be coped with by correcting the reference bias voltage machine by machine.

In the illustrative embodiment, the drum thermistor 10 and fixation thermistor 11, FIG. 3, play the role of means for sensing an inactive state of the copier. The outputs of the thermistors 11 and 10 are read through an AN port when the power switch of the copier is turned on. Generally, when the power switch is turned off after a fixing roller has been warmed up, the temperature of the fixing roller sequentially lowers toward room temperature. Such a temperature drop occurs along a curve which is expressed as:

$$TF = A(-e^{-\frac{t}{B}}) \tag{1}$$

where A and B are the constants particular to a machine, and t is the time.

Assuming that the temperature sensed by the fixation thermistor 11 is TF and the temperature sensed by the drum thermistor 10 is TD, their difference ΔT is produced by:

$$\Delta T = TF - TD \tag{2}$$

In the equation (2), TD substantially equals room temperature if the suspension time is long. Therefore, the duration of an inactive state of the whole copier, i.e., the suspension time of the drum can be estimated from the level of at least one of ΔT (assuming that TD is nearly equal to room temperature) and TF. Since the sensitivity of the drum changes with the suspension time as previously discussed, determining a suspension time in terms of ΔT or TF and correcting the reference bias voltage on the basis of the determined suspension time is successful in promoting efficient and accurate correction. For more accurate detection of suspension time, use may be made of a backed up timer in place of ΔT or TF.

As stated above, in the illustrative embodiment, a suspension time of the copier is determined before the start of background contamination detection so that, when ΔT and/or TF does not satisfy the above condition, background contamination detection may not be performed (a detection start flag is not set (to logical ONE)).

In operation, a reference value for background contamination detection is set. Specifically, after the image adjustment of the copier, the background of the drum 20 and the white reference pattern 28 are exposed and developed by any suitable developing bias, while the density sensor 5 senses their densities. The resulting two outputs of the density sensor 5 are loaded in a non-volatile memory as reference outputs. To hold the conditions of that instant, an optical path length (magnification), lamp voltage, bias output and other various conditions are also stored in the form of data. Specifically, the non-volatile memory is loaded with at least a density output VSGS associated with the drum background, a density output VSST associated with the white reference pattern 28, and a reference bias voltage VBS for developing latent images representative of the drum background and white reference pattern 28. In the illustrative embodiment, the reference value is set under the following conditions:

$$VSGS \geqq 3.6 \text{ volts} \tag{3}$$

$$VSGS \geqq VSST \geqq 3.0 \text{ volts} \tag{4}$$

Thereupon, an inactive state of the copier is detected, as stated previously. If the suspension condition is satisfied, outputs VSGC and VSCK of the density sensor 5 associated with the drum background and the developed white reference pattern, respectively, are read and, at the same time, a bias voltage VBS+ΔVB is applied to develop the drum background and reference white pattern 28. In the illustrative embodiment, for the background density output of 4.0 volts, the density outputs VSST and VSCK and the potential VL of the white reference pattern image have a relationship:

$$\frac{\text{potential change } (\Delta VL) \text{ of reference image}}{\text{density output change } (\Delta VSST) \text{ of reference image}} \approx -57. \tag{5}$$

In this embodiment, the bias voltage for development is provided in 30 volt steps, ΔL is nearly equal to 30 volts and, therefore, the correction value ΔVB is produced by:

$$\Delta B = \tag{6}$$

$$\text{INT}\left\{\frac{vsst - \frac{VSCK \times VSGS}{VSGC}\,(V)}{\frac{5\,(V)}{255\,(\text{bits})}} \div 27\,(\text{bits})\right\} \times 30\,(V)$$

Why the bias voltage is selected to be VBS+ΔVB at the time of comparison value reading is as follows. When the bias voltage VBS is maintained constant, the range which follows ΔVL is (1.0−3.7) volts×(−57)≈154 volts which which is not more than 2.5 notches. In contrast, the bias volage VBS+ΔVB allows the density output associated with the background to lie in the range of 1.0 volt to 3.7 volts at all times, satisfying the equation (5) without fail.

In this manner, the correction value ΔVE is sequentially added up at each time of background contamination detection. Specifically, VSCK is corrected by VSGS and VSGC to produce:

$$VSCK' = VSCK \times \frac{VSGS}{VSGC}$$

By Subsituting it for the equation (5), there is obtained:

$$\frac{\Delta VL}{\Delta VSST} = \frac{\Delta VL}{VSCK' - VSST} \approx -57 \tag{7}$$

In this embodiment, since the output step of the bias voltage is 30 volts, subsituting ΔVL=30 volts for the equation (7) produces:

$$|VSST - VSCK'| = 0.526 \tag{8}$$

Since the difference in pattern density is produced by $$0.526 \div (5.0 \text{ volts}/255 \text{ bits}) \approx 27 \text{ bits},$$

the equation (6) for correcting (VSST−VSCK') by (ΔVE=) 30 volts every twenty-seven bits is obtained in the control aspect.

As stated above, in the illustrative embodiment, the bias voltage VBS is changed until the relationship 3.0≦VSST≦VSGS holds. However, when a BSG error flag or a comparison value error flag is set, the correction data is not added during ordinary copying operation.

Figure 9:
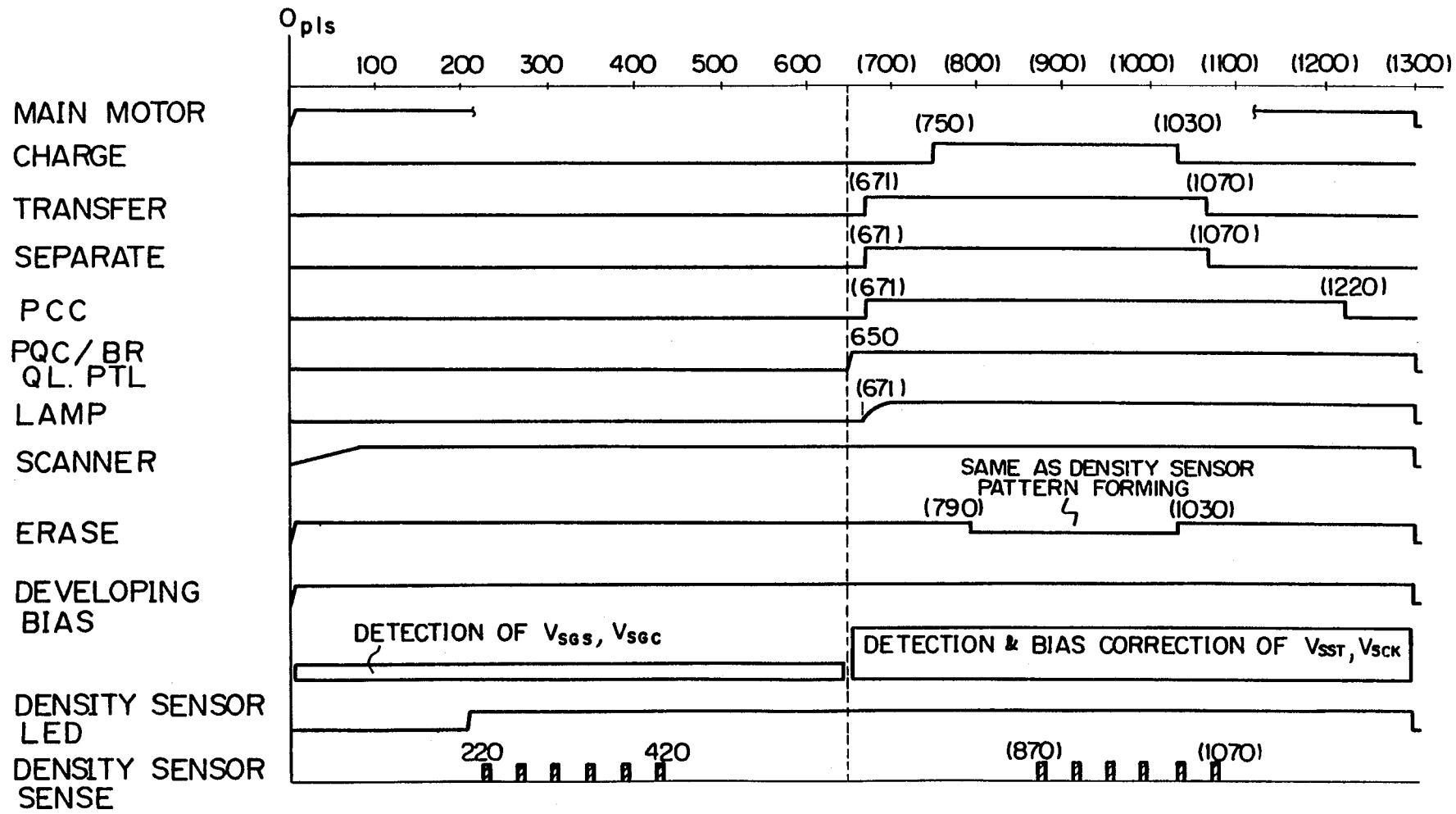
FIG. 9 is a timing chart demonstrating a specific operation of the illustrative embodiment.

Referring to FIG. 9, a specific operation of the illustrative embodiment will be described. As shown, the turn-on of the main motor, charging, image transfer, paper separation, PCC, PQC/BR, QL, PTL, turn-on of the lamp, scanning, erasure, application of the bias voltage for development, and light emission and detection by the density sensor are sequentially performed in the individual clock pulse ranges. Also performed are the detection of VSGS and VSGC, detection of VSST and VSCK, and correction of the bias voltage for satisfying the condition 3.0 volts≦VSST≦VSGS.

The background contamination is ascribable to the elevation of the surface temperature of the drum (drum potential) and the decrease in the amount of exposure which is caused by the contamination of the optics. The decrease in the amount of exposure invites an elevation of the potential VL of the white reference pattern image.

Figure 10:
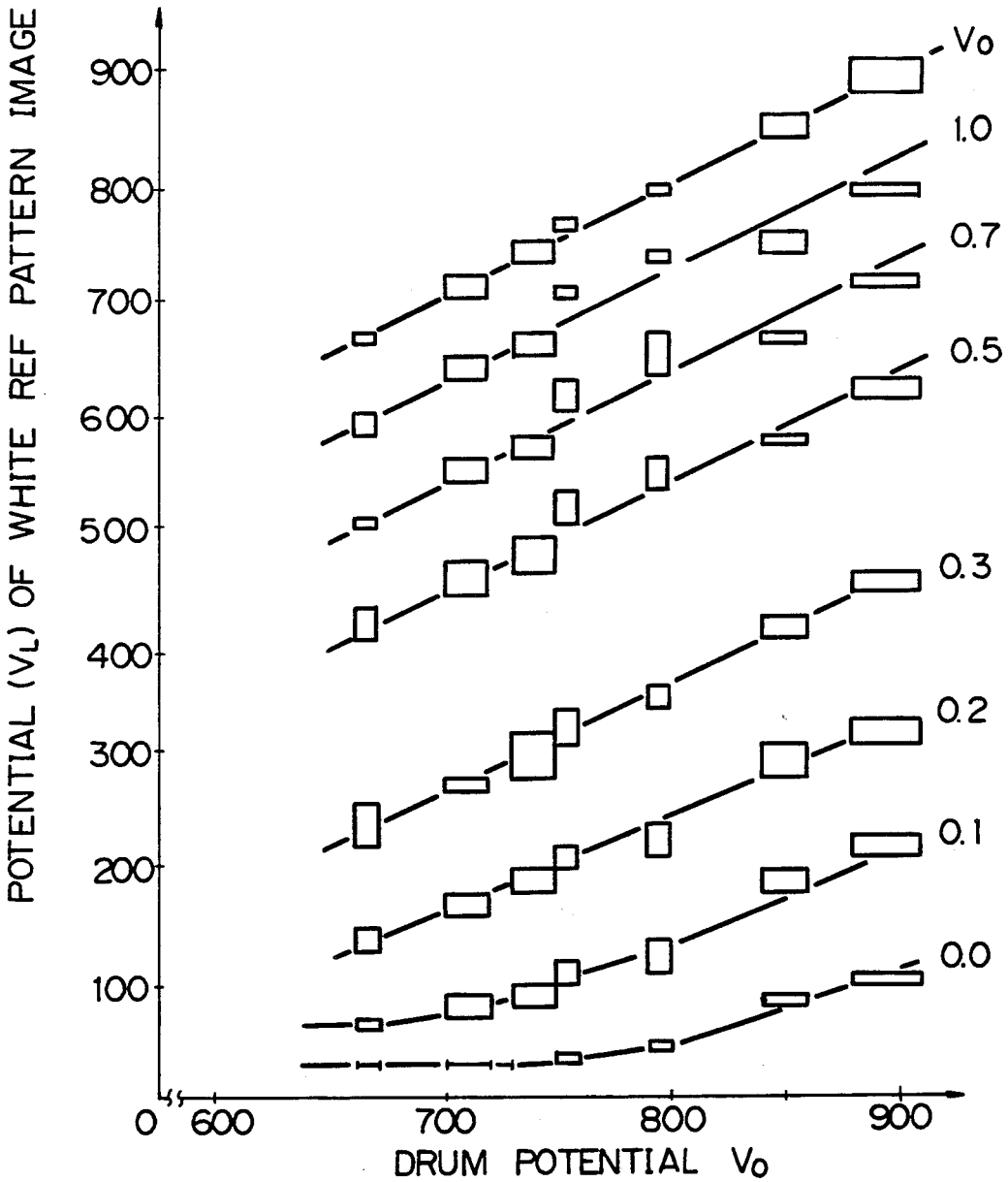
FIG. 10 is a graph showing a relationship between the potential of a photoconductive element and the potential of a white reference pattern.

FIG. 10 indicates a relationship between the drum potential VO and the potential of the white reference pattern image. In the graph, numerical values represented by rectangles indicate scattering.

Figure 11:
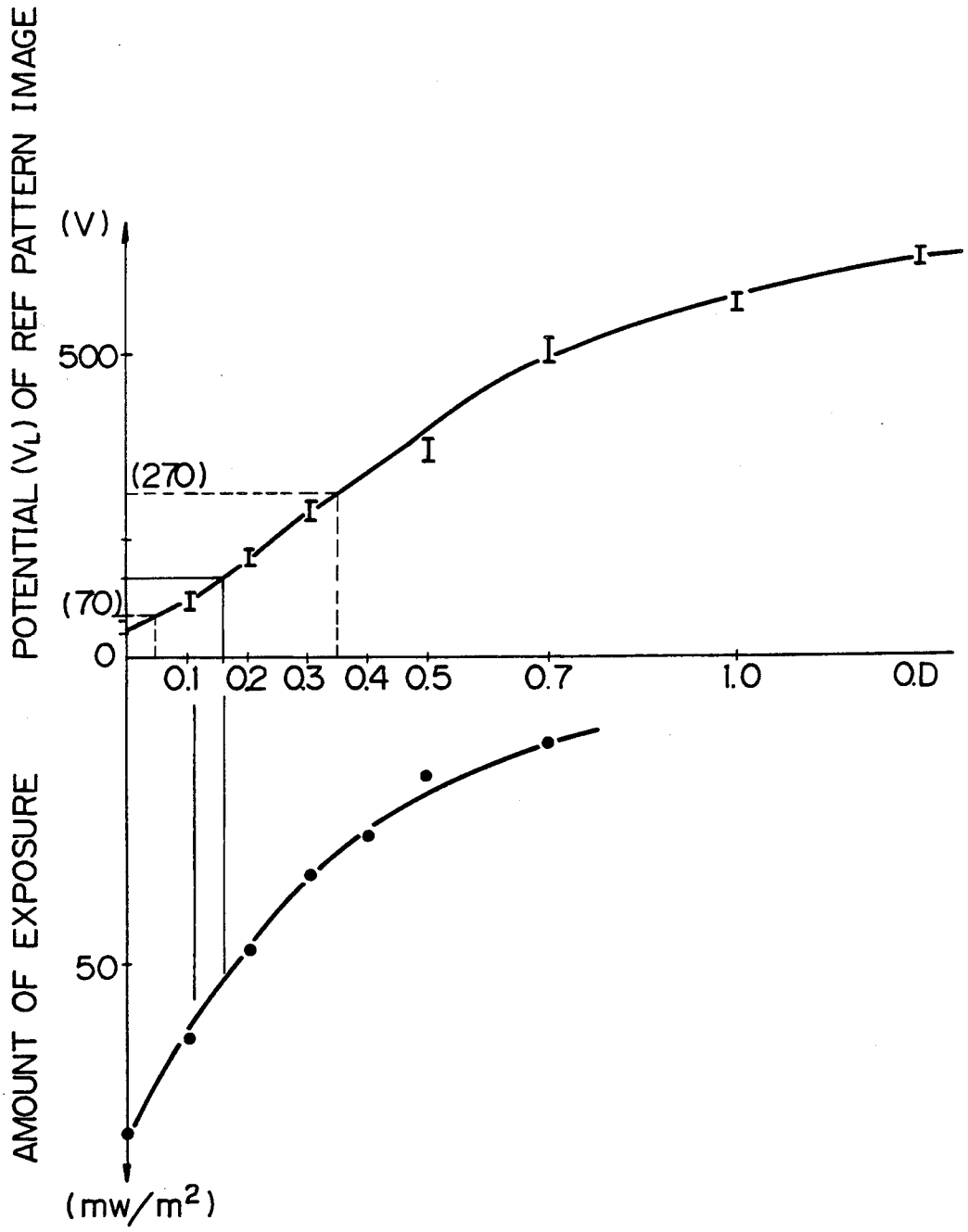
FIG. 11 is a graph showing a relationship between the amount of imagewise exposure and the potential of the white reference pattern.

FIG. 11 shows a relationship between the amount of exposure and the potential VL of the white reference pattern image. When this relationship was determined, the drum potential VO, thermistor temperature and drum temperature were 760 volts, 32° C. to 33° C., and 25° C. to 27° C., respectively.

Figure 12:
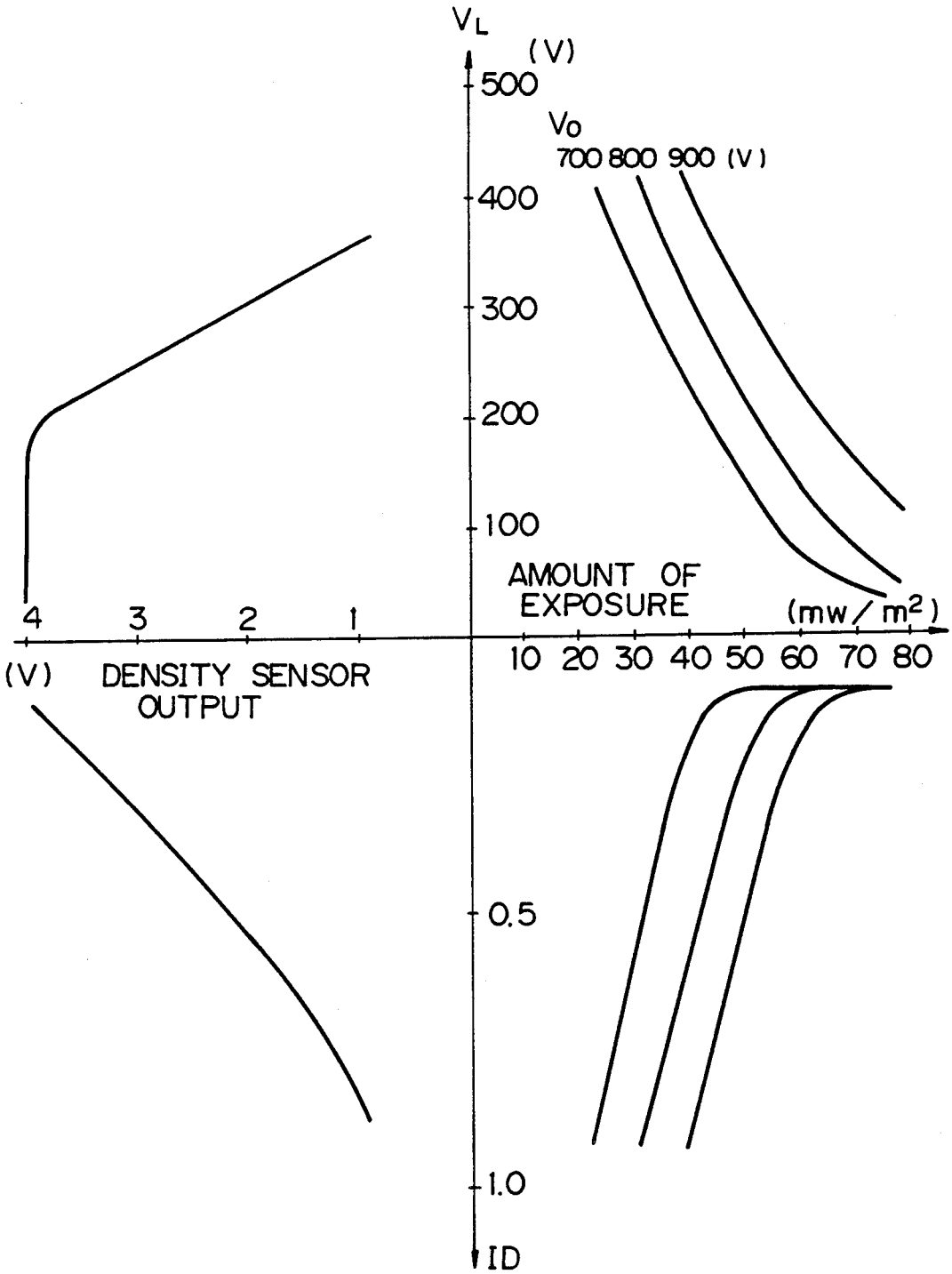
FIG. 12 is a graph showing a relationship between the potential of the white reference pattern and the output of a density sensor.

FIG. 12 shows a relationship between the potential VL of the white reference pattern image and the output of the density sensor by using the drum potential VO as a parameter.

Figure 13:
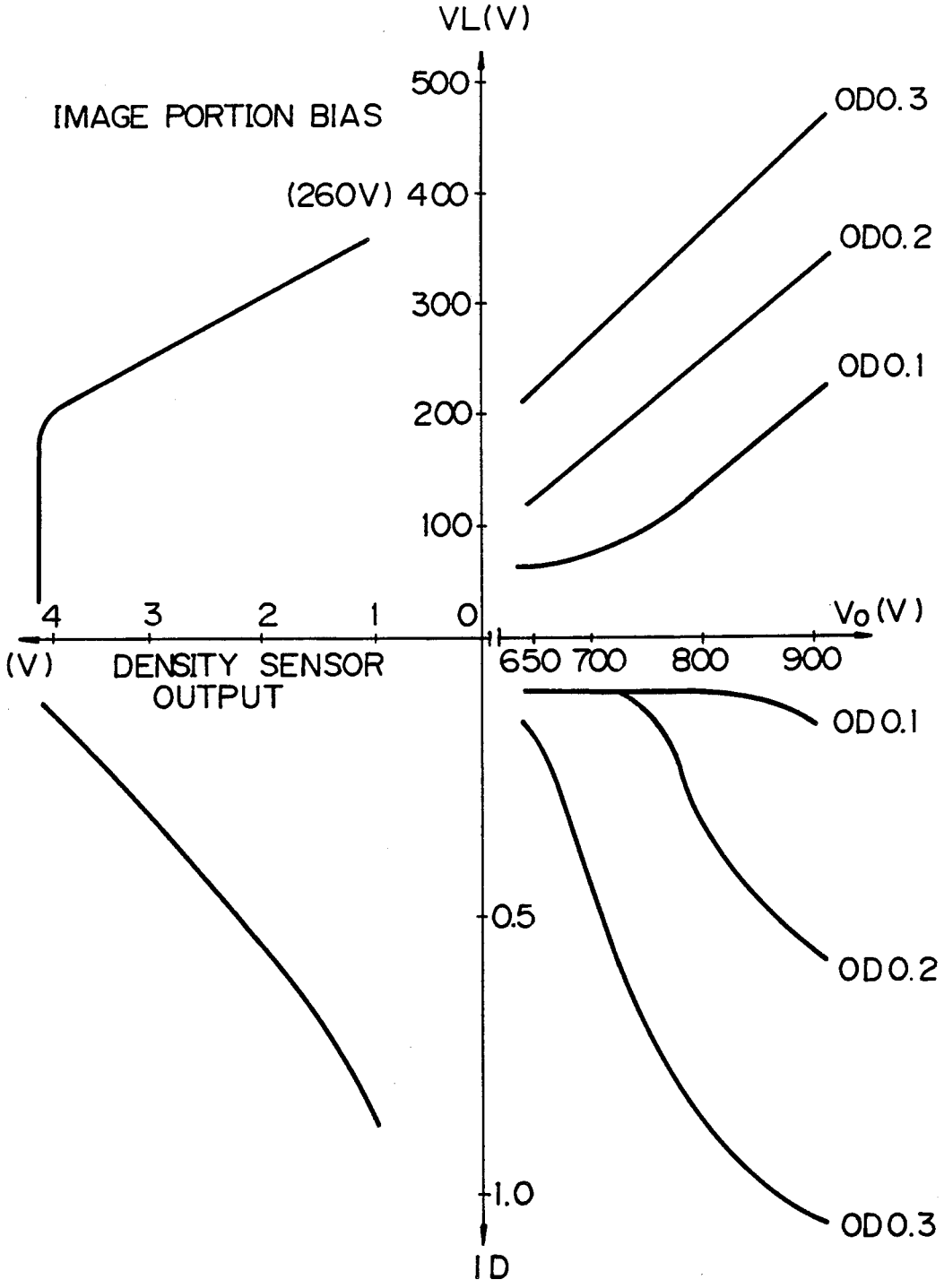
FIG. 13 is a graph showing a relationship between the potential of the photoconductive element and the potential of the white reference pattern with respect to density.

FIG. 13 shows a relationship between the potential VL of the white reference pattern image and the output of the density sensor with respect to various densities.

The general procedure for correcting the bias voltage particular to the illustrative embodiment will be described.

Figure 14:
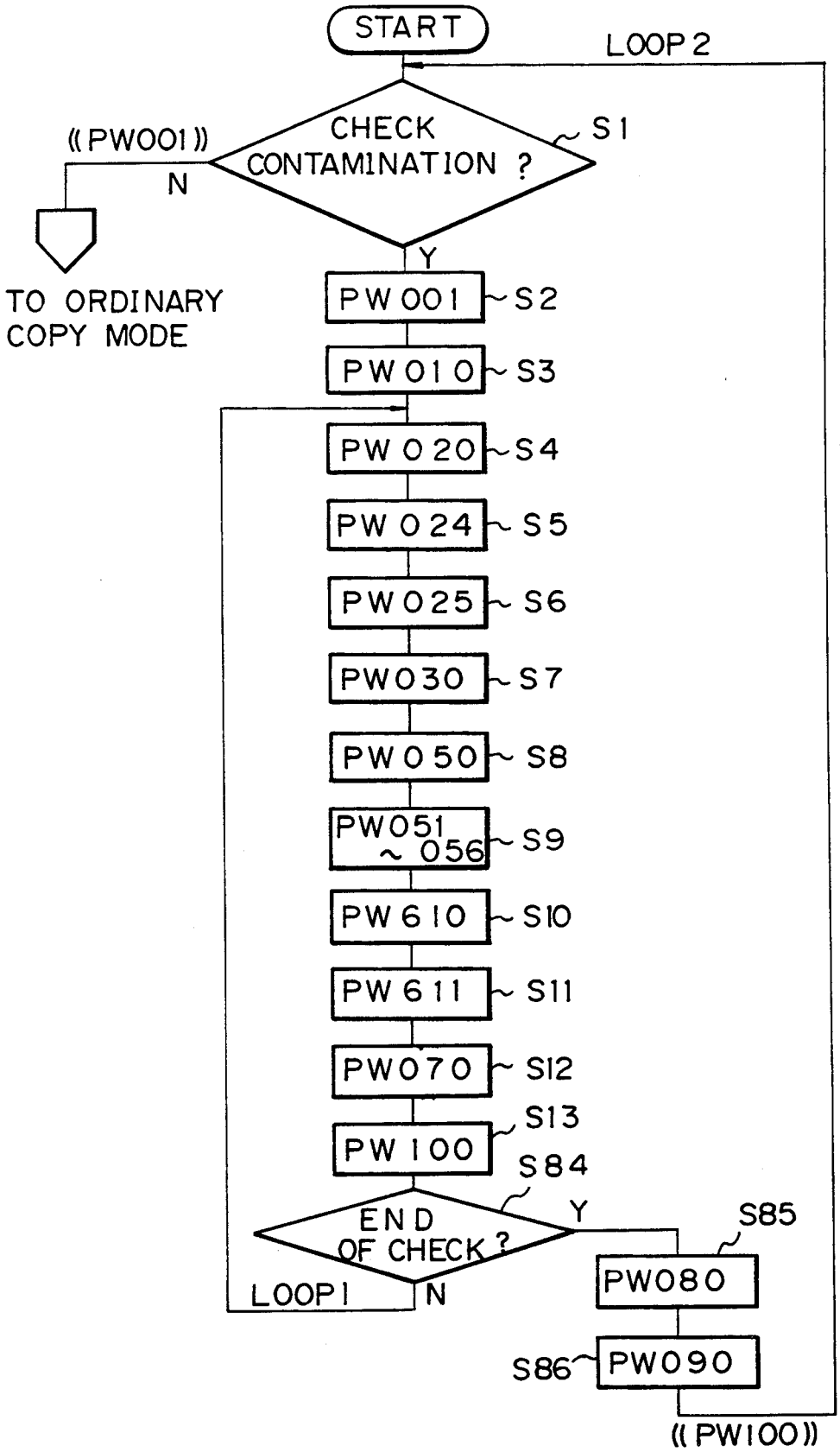
FIGS. 14 to 22 are flowcharts demonstrating specific operations of the illustrative embodiment.
Figures 15, 15A, 15B:
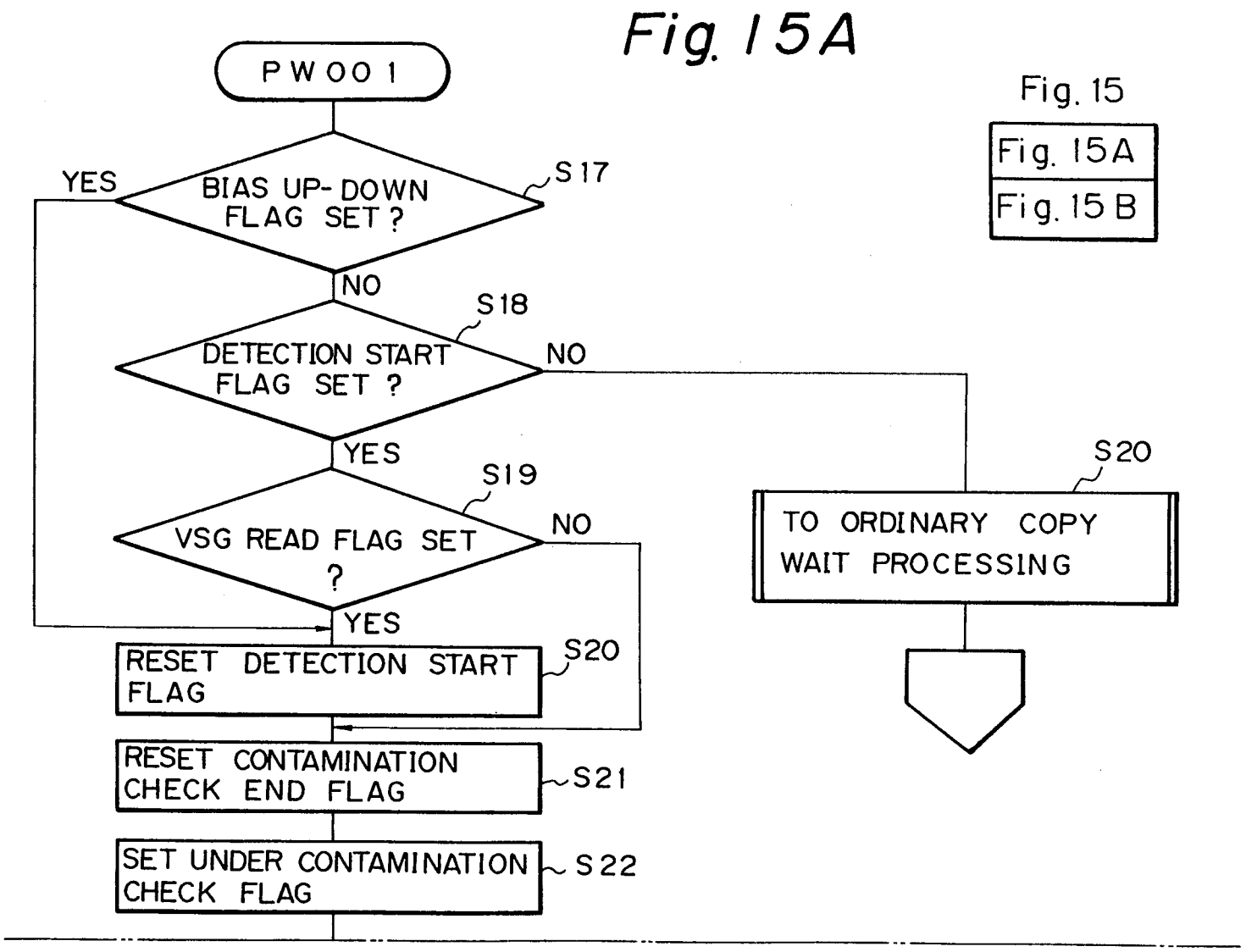
Figure 15B:
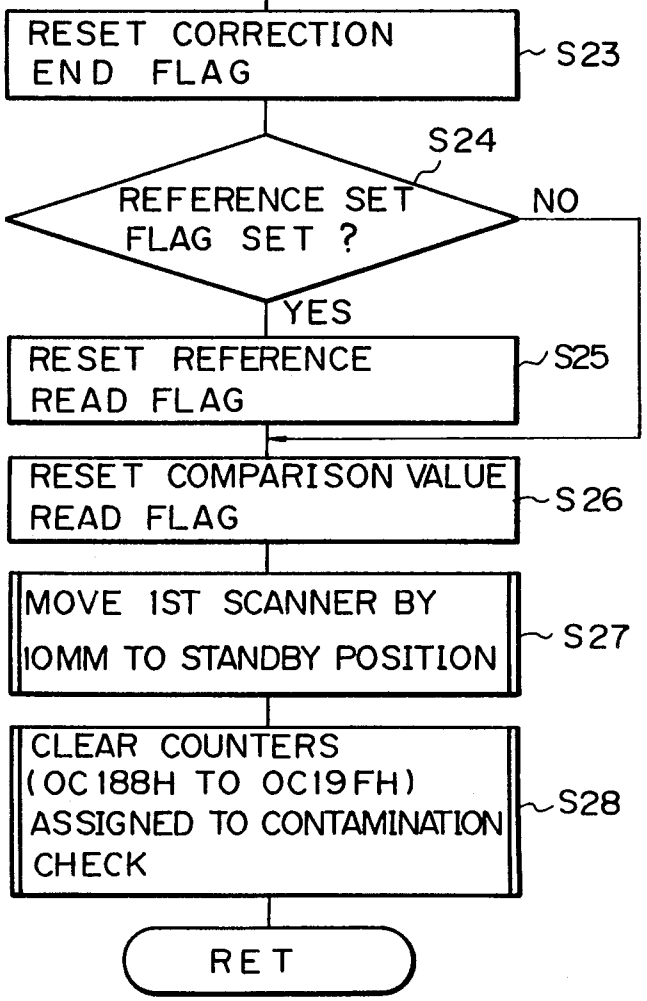

Referring to FIG. 14, a main routine begins with a step S1 for determining whether or not the suspension condition of the copier is satisfied. If the answer of the step S1 is YES, a step S2 is executed; if otherwise, a copying operation is performed in an ordinary copy mode. The subroutine represented by the step S2 is executed as shown in FIG. 15 specifically. In FIG. 15, if a bias up-down flag is not set as determined in a step S17, whether or not a detection start flag is set is determined in a step S18. If the answer of the step S18 is YES, the program advances to a step S19; if otherwise, the program enters into an ordinary copy wait routine. If a read flag is set as determined in the step S19, the detection start flag is set in a step S20 and a contamination check end flag is set in a step S21. If the answer of the step S19 is NO, the program directly advances to a step S21. If the answer of the step S17 is YES, the program directly advances to the step S20. In a step S22, an under contamination check flag is set. In the following step S23, a correction end flag is reset. Then, in a step S24, whether or not a reference set flag is set is determined. If the answer of the step S24 is YES, a reference read flag is reset in a step S25 and, in a step S26, a comparison value read flag is reset. This is followed by a step S27 in which a first scanner is moved by 10 millimeters to a standby position. In the next step S28, various counters assigned to background contamination checking are cleared.

Figure 16:
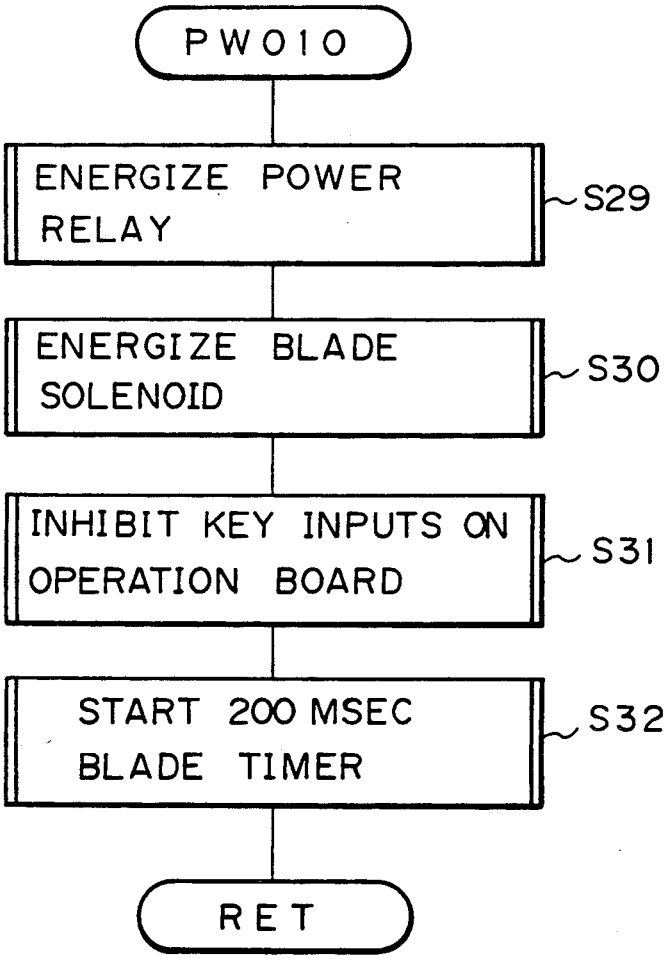

A step S3 shown in FIG. 14 is shown in FIG. 16 specifically. In a step S29, a power relay is turned on and, in a step S30, a solenoid associated with a blade is energized. In a step S31, key inputs on the operation board are inhibited. This is followed by a step S32 for starting a 200 milliseconds timer assigned to the blade.

Figure 17:
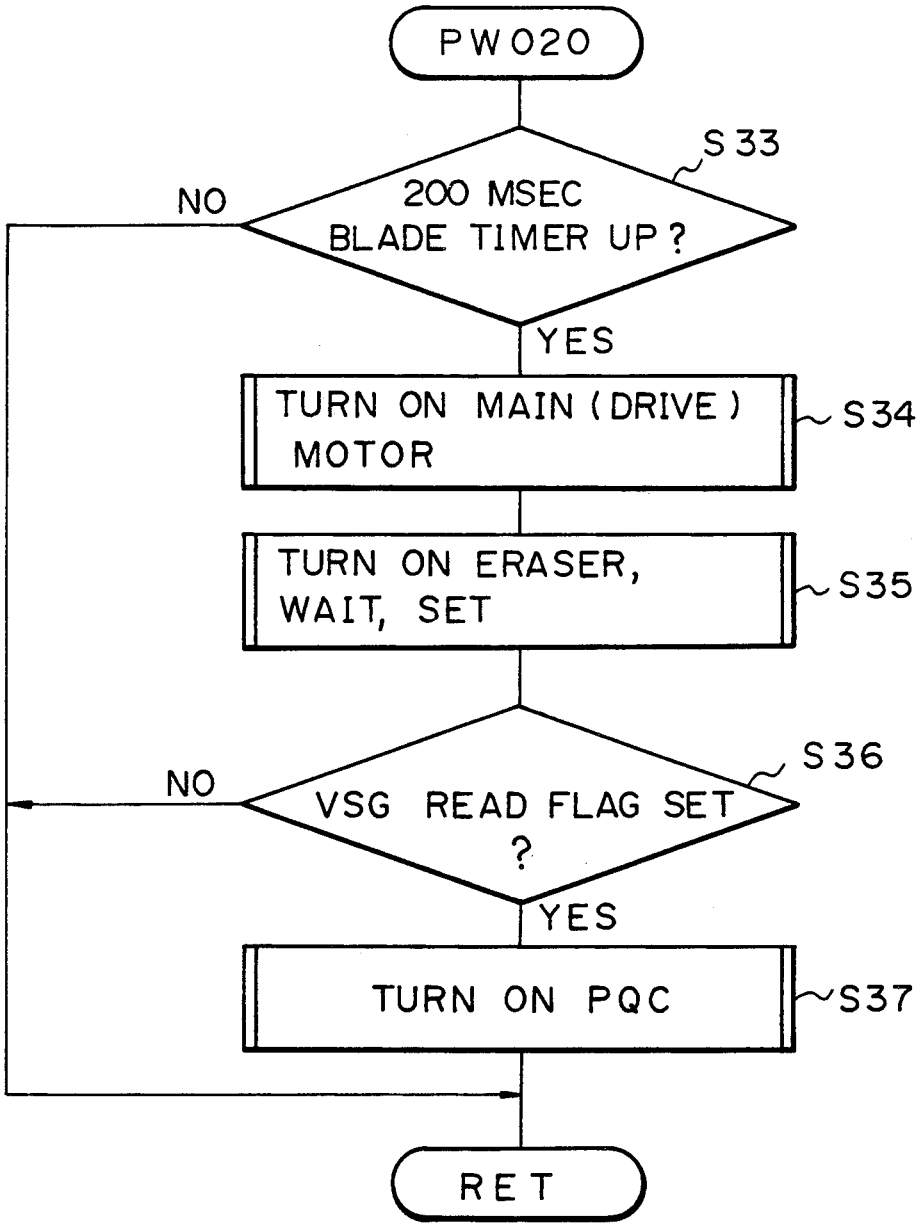

FIG. 17 shows a step S4 of FIG. 14 specifically. In a step S33, whether or not the above-mentioned 200 milliseconds timer is incrementing is determined. If the answer of the step S33 is YES, a step 34 is executed for turning on the main motor, and then a step S35 is executed for turning on the eraser. When a VSG read flag is set as decided in a step S36, a step S37 is executed for turning on PQC. In this manner, by the step S4 shown in FIG. 14, the scanner is moved to the position where the white reference pattern is located.

Figure 18:
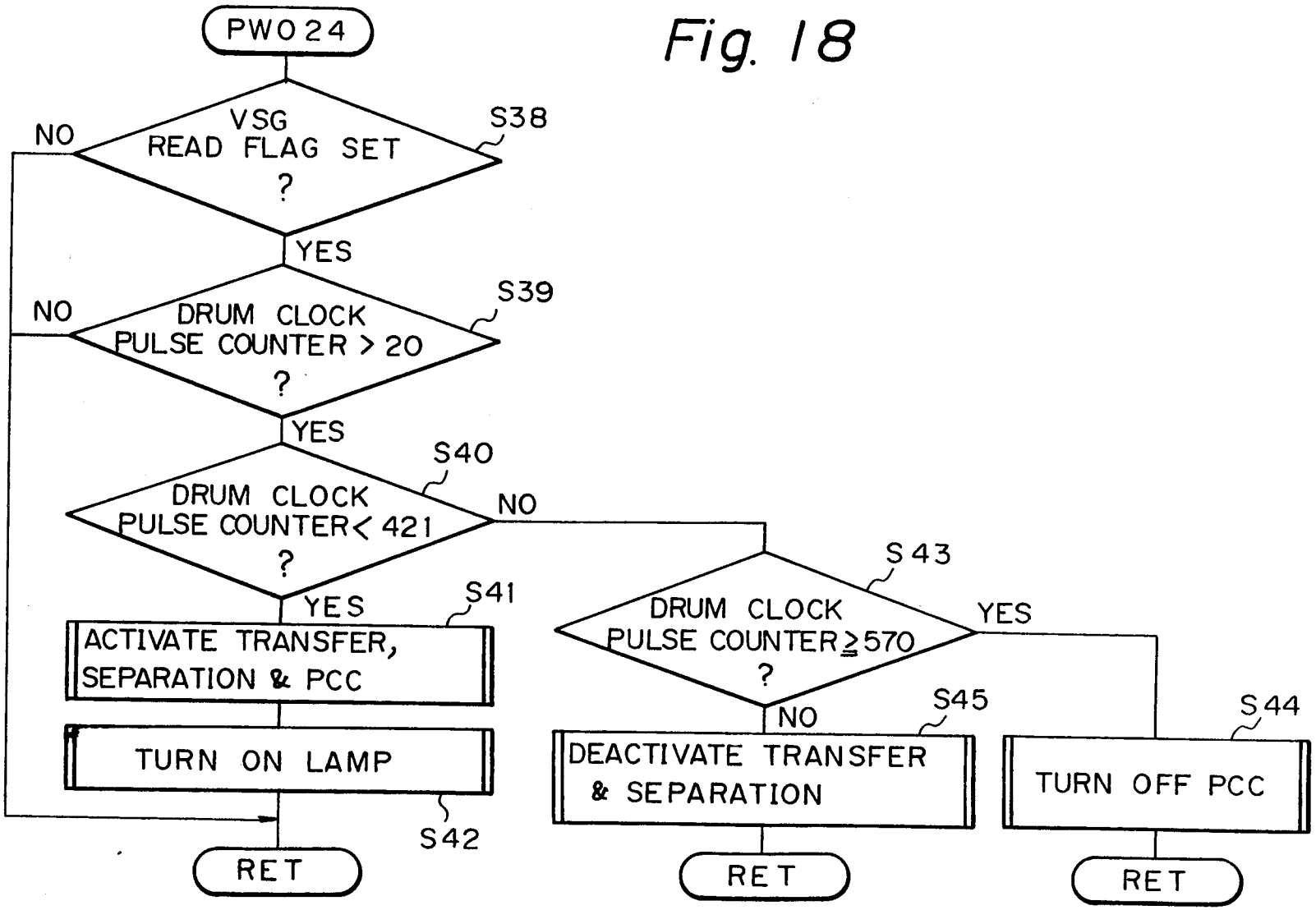

A step S5 of FIG. 14 is shown in FIG. 18 specifically. When the VSG read flag is set as decided in a step S38, a step S39 is executed to see if a drum clock pulse counter has exceeded "20". If the answer of the step S39 is YES, the program advances to a step S40. In the step S40, whether or not the drum clock pulse counter has exceeded "421" is determined. If the answer of the step S40 is YES, the program advances to a step S41 for activating the image transferring section, paper separating section, and PCC. This is followed by a step S42 for turning on the lamp. If the answer of the step S40 is NO, a step S43 is executed to see if the drum clock pulse counter has reached "570". If the answer of the step S43 is YES, a step S44 is executed for turning off PCC; if otherwise, a step S45 is executed for deactivating the transferring and paper separating sections.

Figure 19:
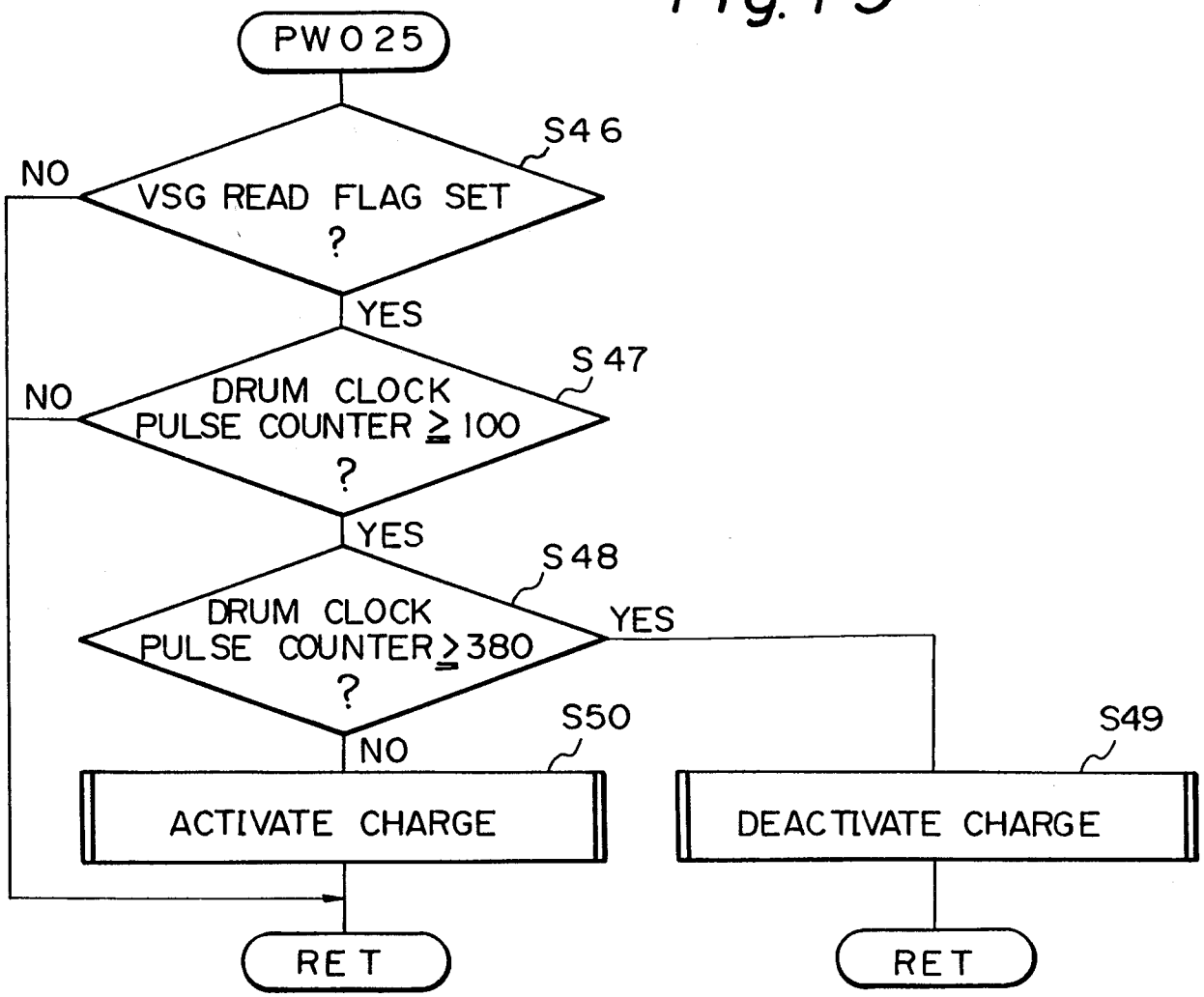

FIG. 19 indicates a step S16 of FIG. 14 specifically. As shown, when the VSG read is set as decided in a step S46, a step S47 is executed to see if the drum clock pulse counter has reached "100". If the answer of the step S47 is YES, whether or not the drum clock pulse counter has reached "380" is determined by a step S48. If the answer of the step S48 is YES, a step S49 is executed to turn off the charging section; if otherwise, a step S50 is executed to turn it on.

Figure 20:
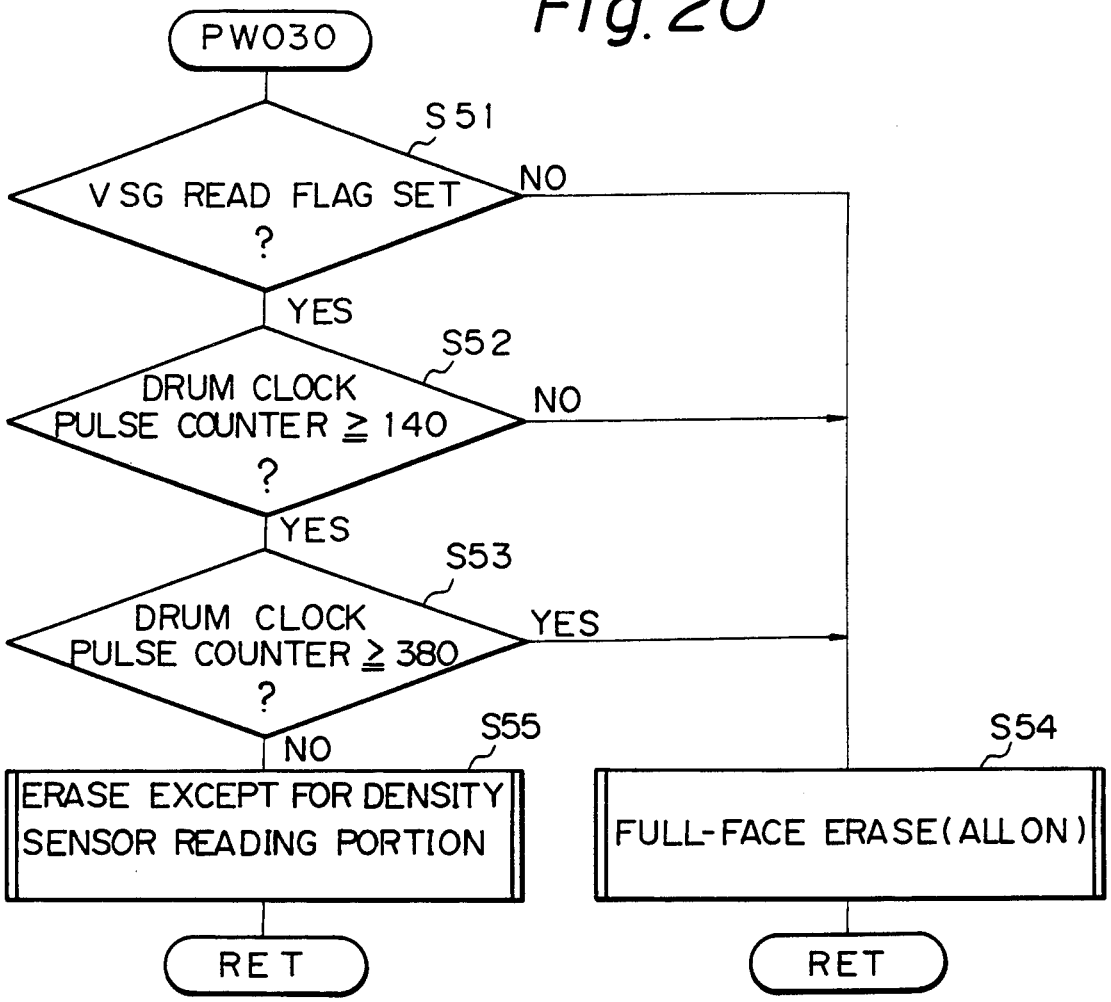

FIG. 20 shows a step S7 of FIG. 14 specifically. As shown, in a step S51, whether or not the VSG read flag is set is determined. If the answer of the step S51 is YES, a step S52 is executed to see if the drum clock pulse counter has exceeded "140". If the answer of the step S52 is YES, a step S53 is executed to see if the drum clock pulse counter has exceeded "380". If the answer of the step S53 is YES, full-face erase processing is executed in a step S54; if otherwise, a step S55 is executed for executing erase processing except for the density sensor reading section. When the answer of the steps S51 and S52 are NO and when the answer of the step S53 is YES, the program advances to the step S54.

Figure 21:
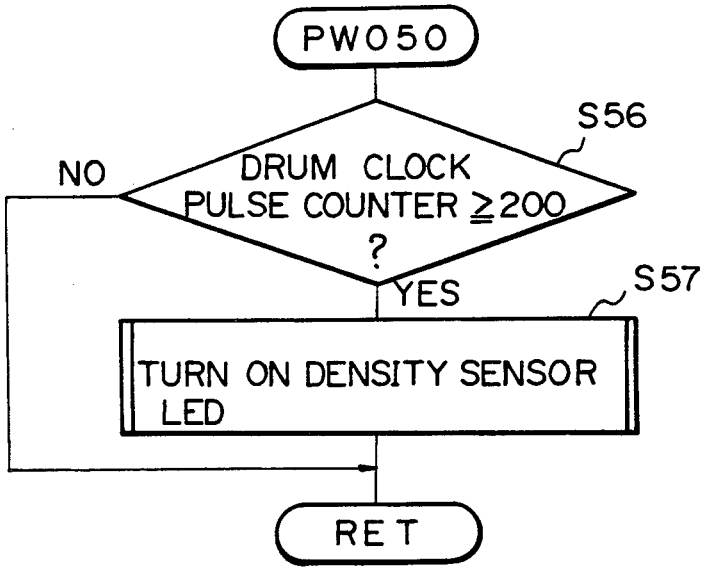

FIG. 21 shows a step S8 of FIG. 14 specifically. In FIG. 21, whether or not the drum clock pulse counter has exceeded "200" is determined in a step S56. If the answer of the step S56 is YES, a step S57 is executed to turn on the LED of the density sensor.

Figure 22:
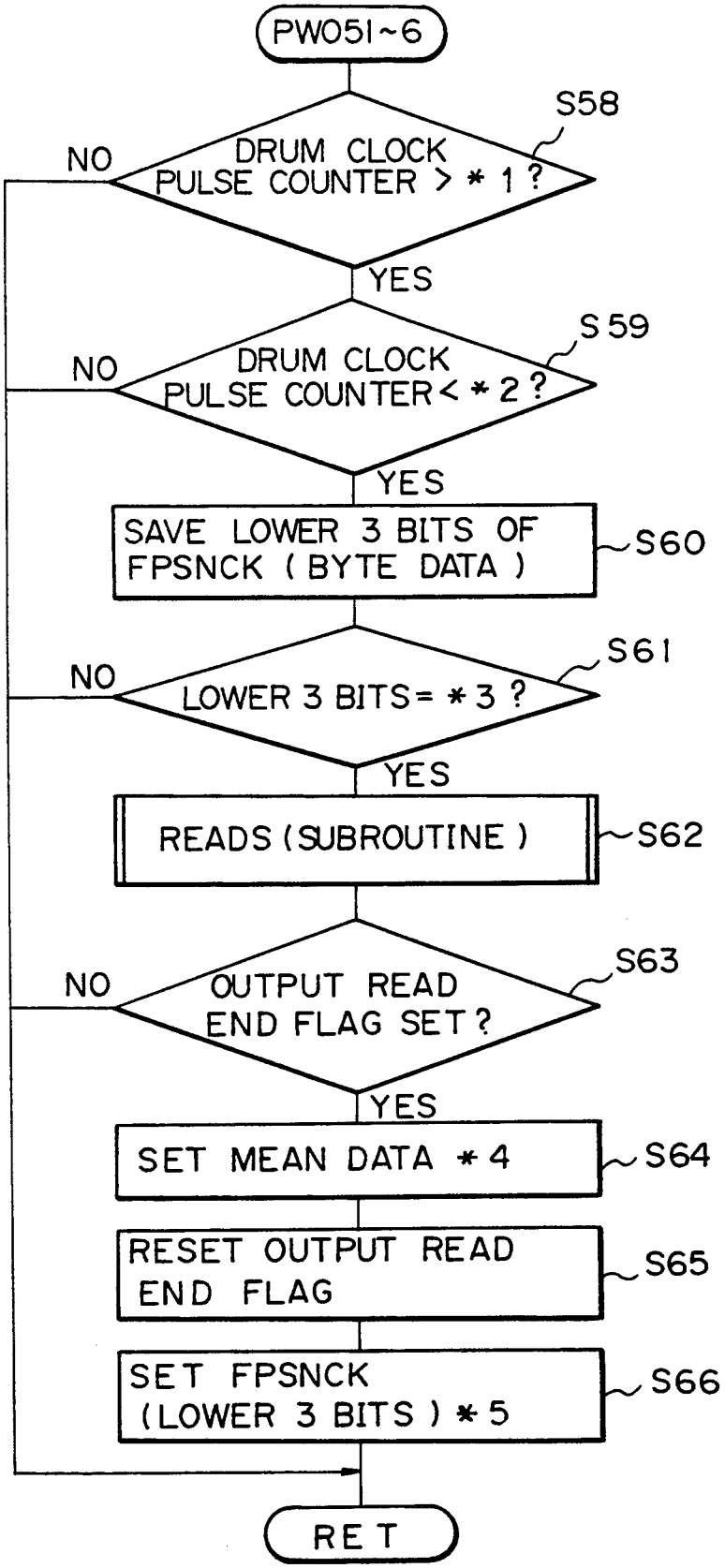

FIG. 22 shows a step S9 of FIG. 14 specifically. When the drum clock pulse counter has increased beyond a predetermined value as decided in a step S58, a step S59 is executed to see if the drum clock pulse counter has not exceeded another predetermined value. If the answer of the step S59 is YES, a step S60 is executed to save lower three bits of byte data. When the lower three bits are associated with a predetermined read processing operation as decided in a step S61, a step or subroutine S62 is executed. Then, the program advances to a step S63 to see if an output read end flag has been set. If the answer of the step S63 is YES, a step S64 is executed to memorize mean data in a particular address which differs from one read processing to another. In a step S65, the output read end flag is reset, and in a step S66 the lower three bits are changed for the next read processing. FIG. 23 shows details of steps S58, S59, S61, S64 and S66 of FIG. 22 each being associated with a particular angular position.

Figure 24:
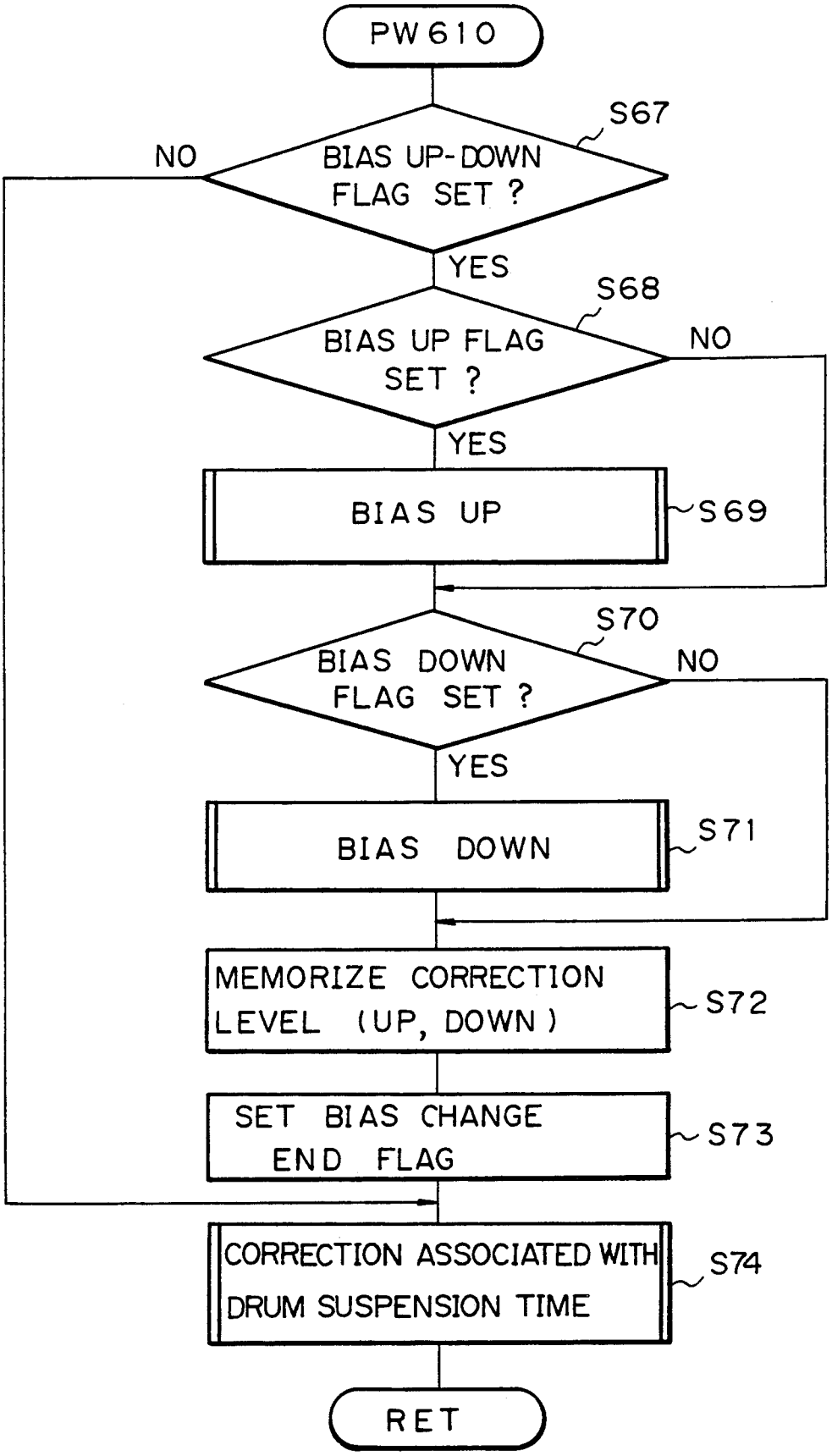
FIGS. 24 to 32 are flowcharts showing specific operations of the illustrative embodiment.

FIG. 24 shows a step S10 of FIG. 14 specifically. As shown, when the bias up-down flag is set as decided in a step S67, a step S68 is executed to see if a bias up flag is set. If the answer of the step S68 is YES, a correction for increasing the bias voltage is effected in a step S69, followed by a step S70. If the answer of the step S68 is NO, the program directly advances to the step S70. In the step S70, whether or not a bias down flag is set is determined. If the answer of the step S70 is YES, a step S71 is executed to effect a correction for reducing the bias voltage, followed by a step S72. If the answer of the step S70 is NO, the program directly advances to the step S72. In the step S72, the correction level is memorized. In a step S73, a bias change end flag is set, in a step S74 a correction associated with a drum suspension time is executed. This correction associated with a drum suspension time is equivalent to a correction which is performed during ordinary copying operation, i.e., a degree of recovery of the drum from fatigue is estimated beforehand so that a correction based on the estimated recovery is effected by a bias or similar output.

Figure 25:
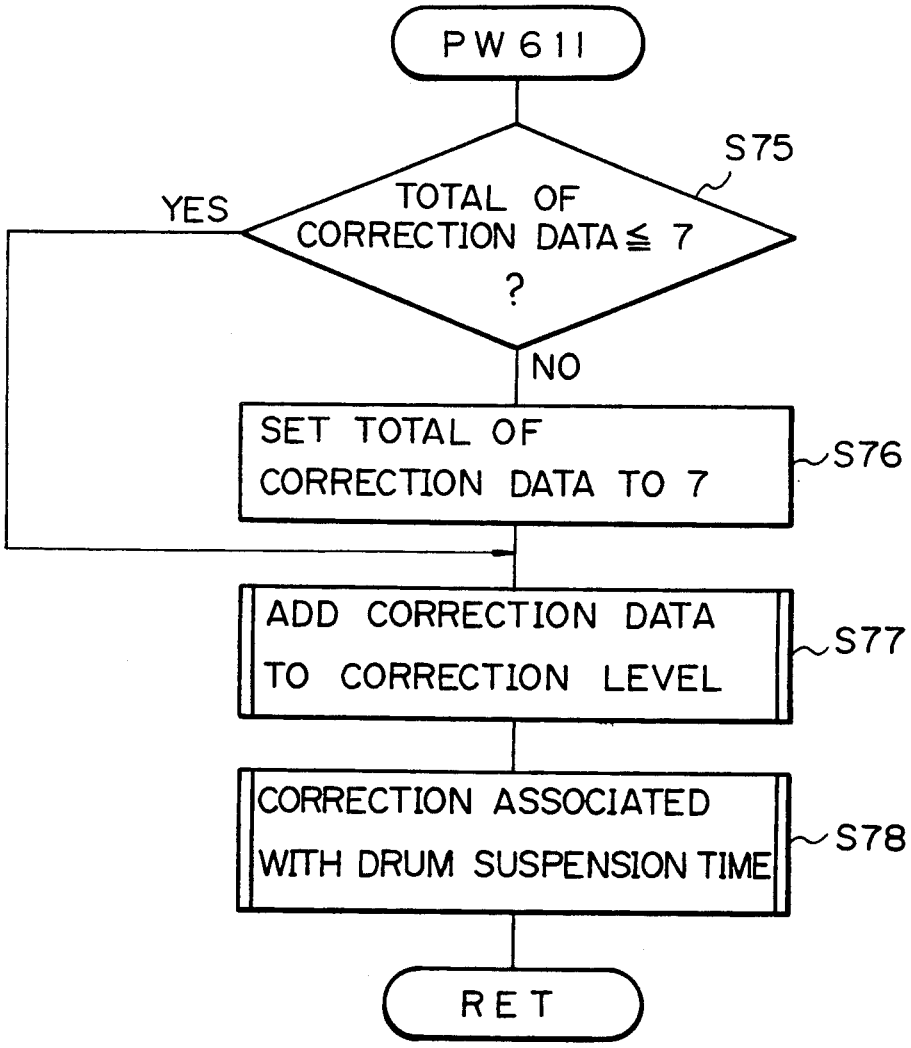

FIG. 25 shows a step S11 of FIG. 14 specifically. In a step S75, whether or not the total of correction data is smaller than "7" is determined. If the answer of the step S75 is NO, a step S76 is executed to set the total of correction data to "7". This is followed by a step S77. If the answer of the step S75 is YES, the program directly advances to the step S77. In the step S77, the correction data is added to the correction level. Then, a step S78 is executed to execute a correction associated with the drum suspension time.

Figure 26:
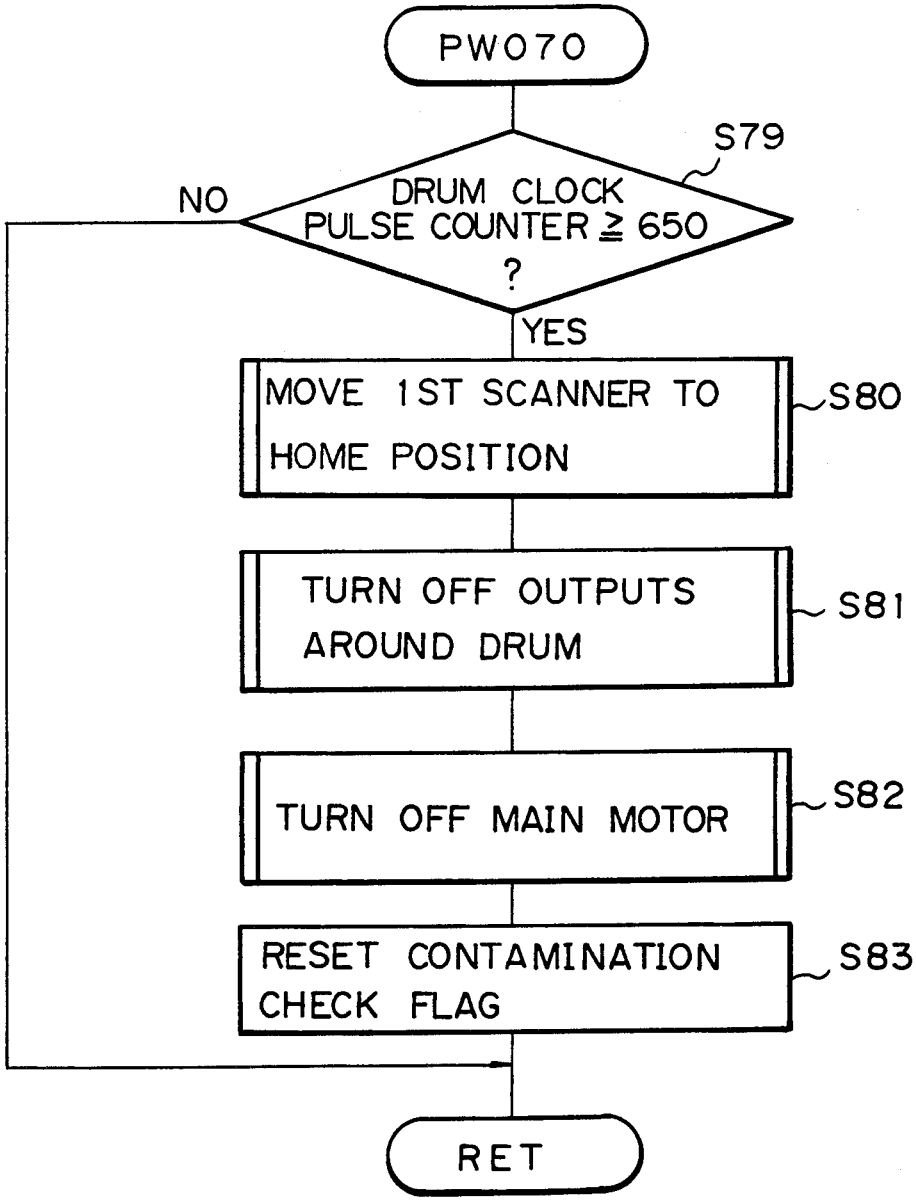

FIG. 26 shows a step S12 of FIG. 14 specifically. Whether or not the drum clock pulse counter has reaches "650" is determined in a step S79. If the answer of the step S79 is YES, a step S80 is executed to move the first scanner to the home position. This is followed by a step S81 for turning off various outputs around the drum. Then, a step S82 is executed to turn off the main motor, followed by a step S83 for resetting the under contamination check flag.

Figure 27:
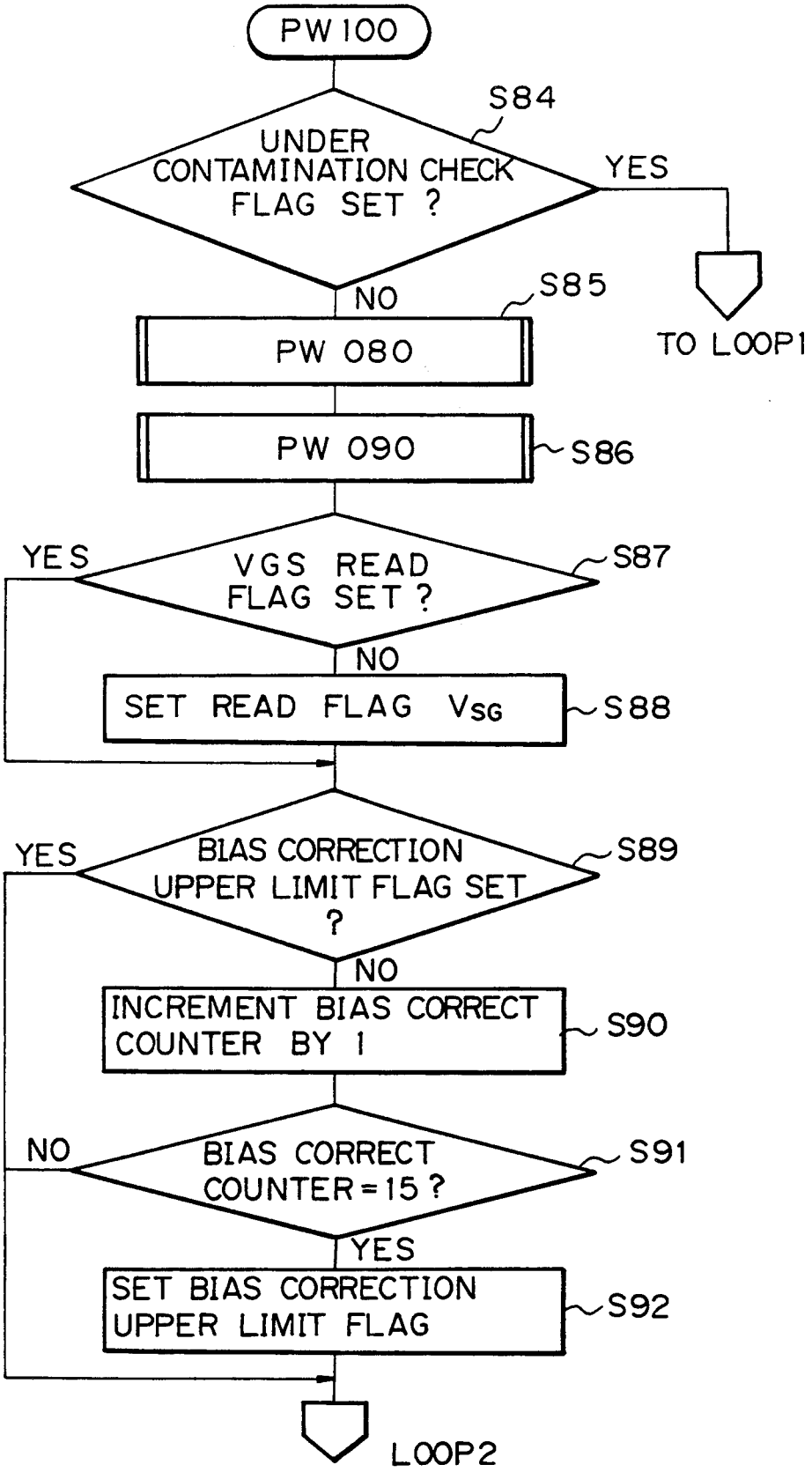
Figure 30:
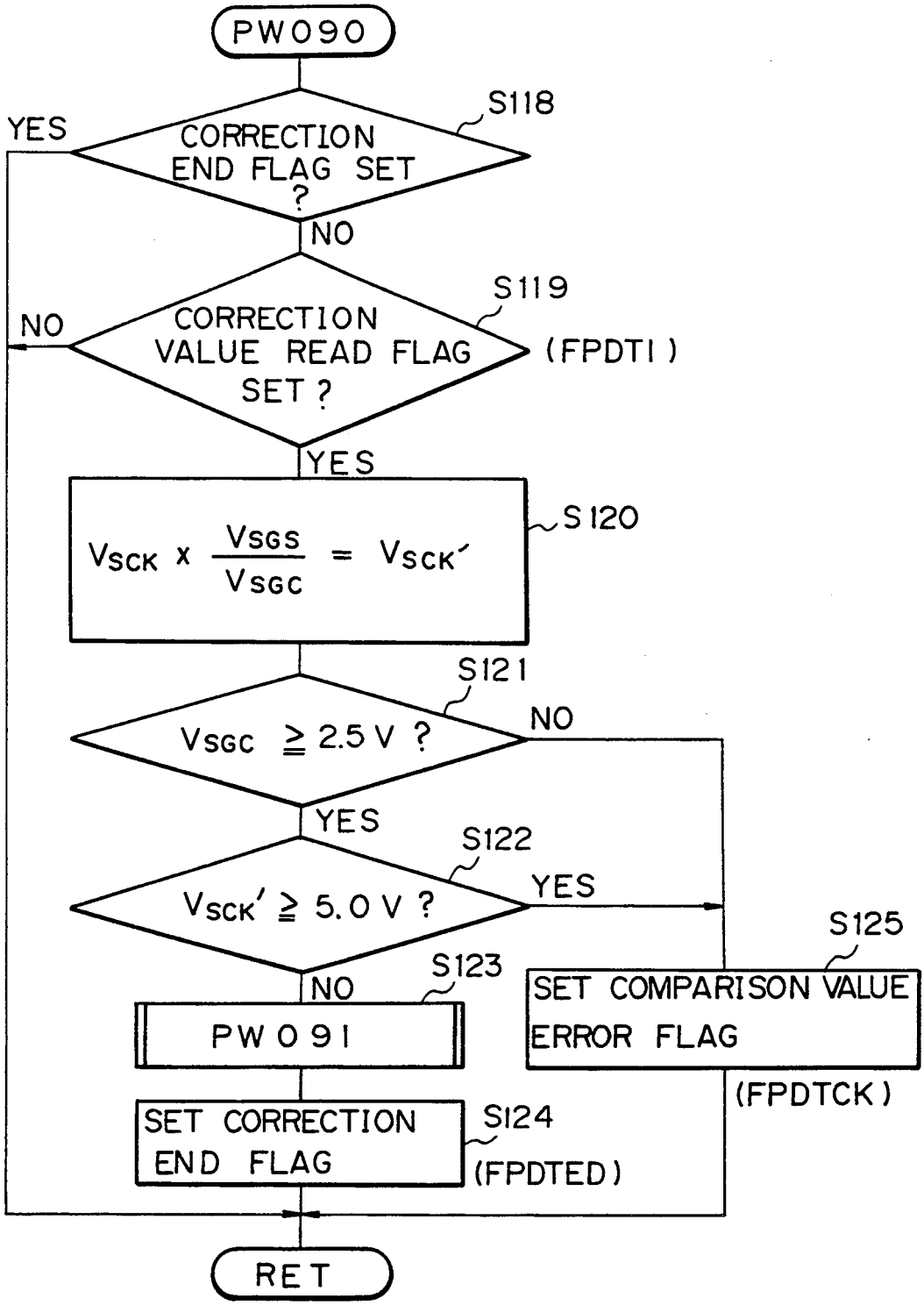

FIG. 27 shows a step S13 of FIG. 14 specifically. Whether or not the under contamination check flag is set is determined in a step S84. If the answer is NO, LOOP 1 shown in FIG. 14 is executed; if it is YES, a step S85 or PWO80 processing (FIG. 28) is executed. The step S85 is followed by a step S86 or PWO90 processing (FIG. 30). Thereafter, if the VSG read flag is set as decided in a step S87, a step S89 is executed to see if a bias correction upper limit flag is set. If the answer of the step S89 is NO, a bias correct counter is incremented in a step S90. This is followed by a step S91 for determining whether or not the bias correct counter is equal to "15". If the answer is YES, a step S92 is performed to set the bias correction upper limit flag.

Figures 28, 28A:
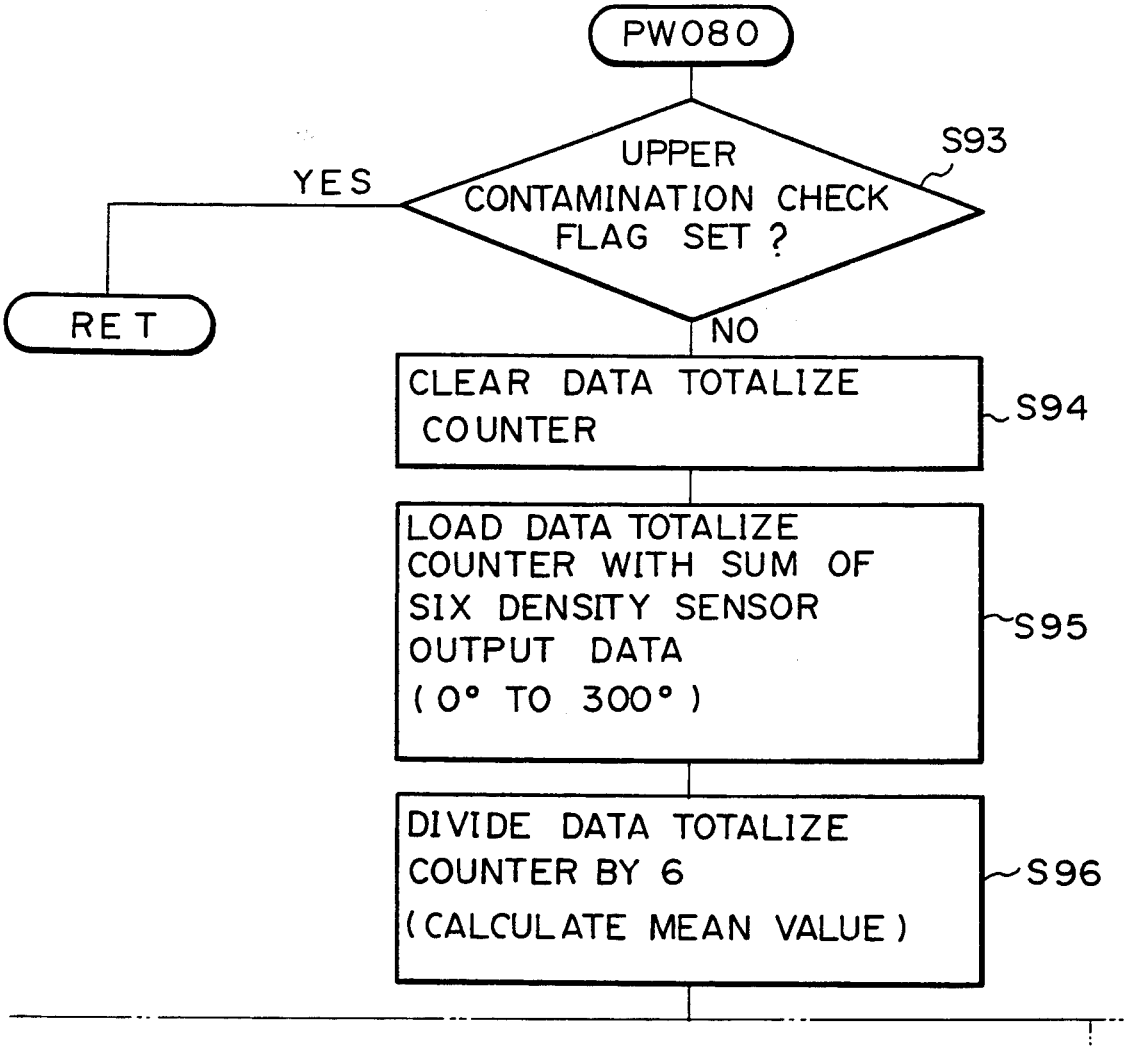
Figure 28B:
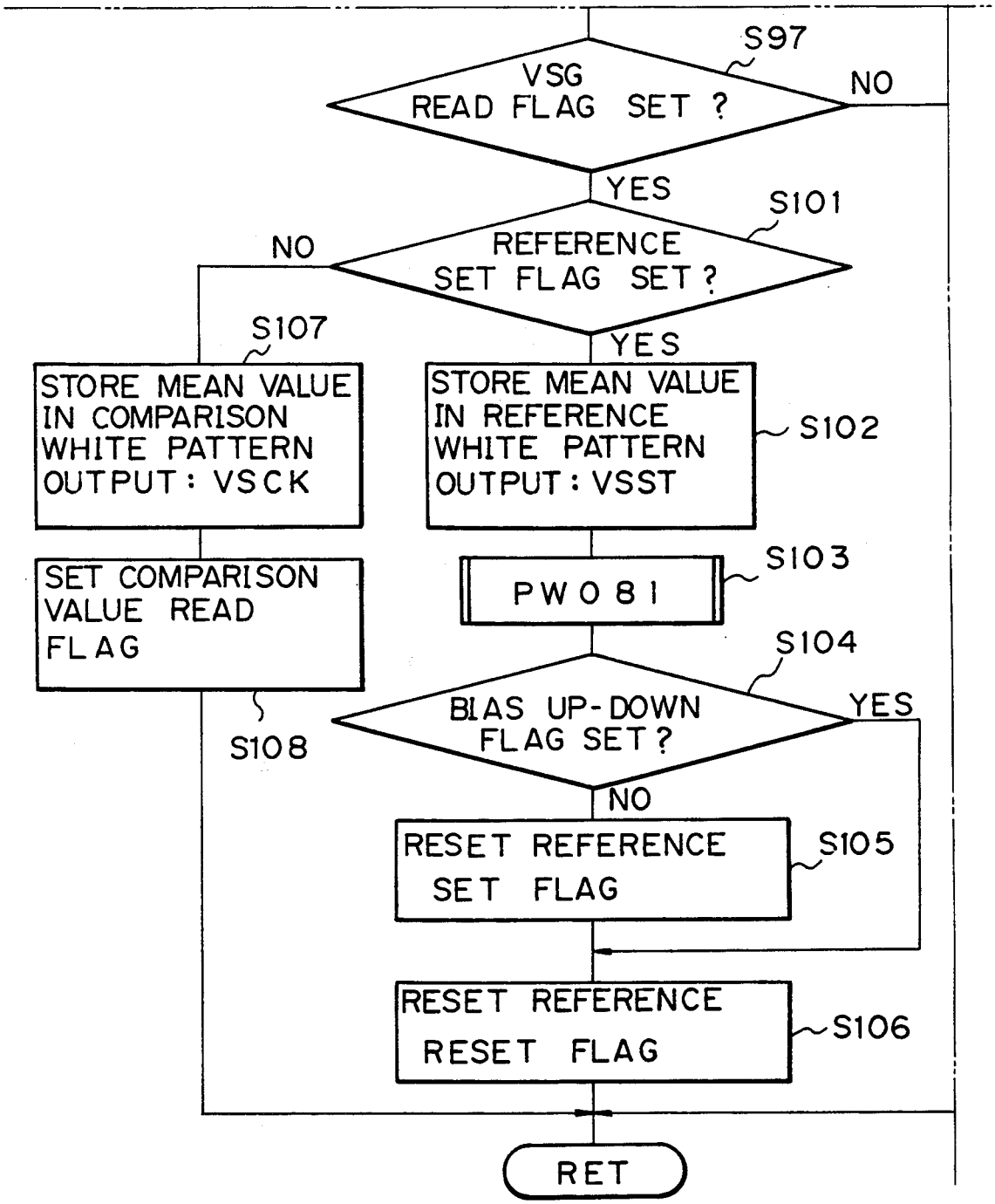
Figure 28C:
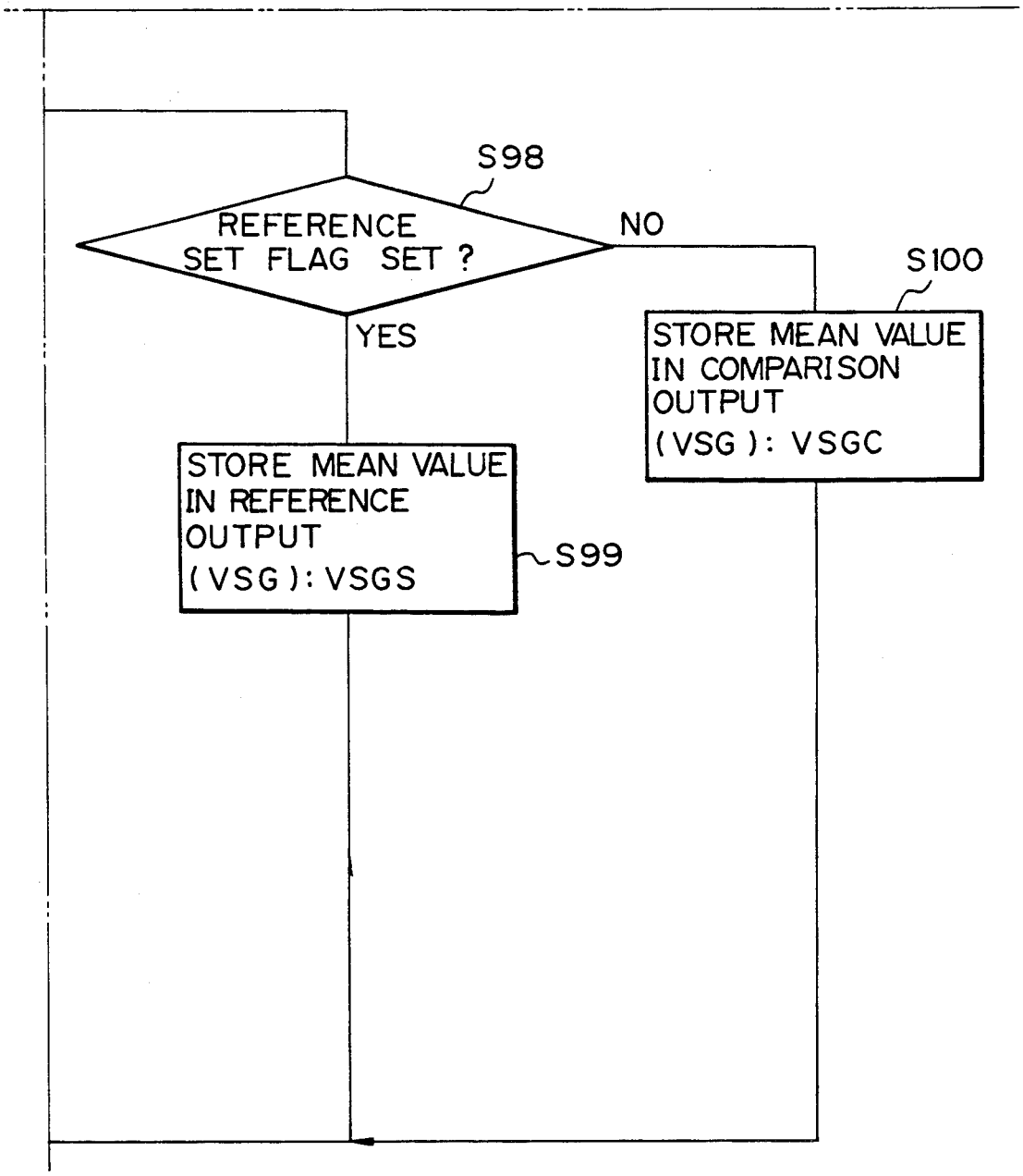

FIG. 28 shows the step S85 of FIG. 27 specifically. As shown, whether or not the under contamination check flag is set is determined in a step S93. If the answer is NO, a step S94 is performed to clear a data totalize counter. This is followed by a step S95 for loading the data totalize counter with the sum of six output data associated with the individual angular positions of the density sensor. Then, in a step S96, the value stored in the data totalize counter is divided by 6 to produce a mean value. In a step S97, whether or not the VSG read flag is set is determined. If the answer of the step S97 is NO, a step S98 is executed to see if the reference set flag is set. If the answer of the step S98 is YES, a step S99 is executed to memorize the mean value as the reference output VSGS; if otherwise, a step S100 is executed to memorize the mean value as the comparison output VSGC. If the answer of the step S97 is YES, whether or not the reference set flag is set is determined in a step S101. If the answer of the step S101 is YES, a step S102 is executed to memorize the mean value as a reference white pattern image output. Next, a step S103 (FIG. 29) and a step S104 are sequentially executed to see if the bias up-down flag is set. If the answer is NO, a step S105 is executed to reset the reference set flag. In the following step S106, a reference read flag is set. If the answer of the step S104 is YES, the operation is transferred to a step S106. If the answer of the step S101 is NO, a step S107 is executed to memorize the mean value as the comparison output VSCK of the white reference pattern, followed by a step S108 for setting a comparison value set flag.

Figure 29:
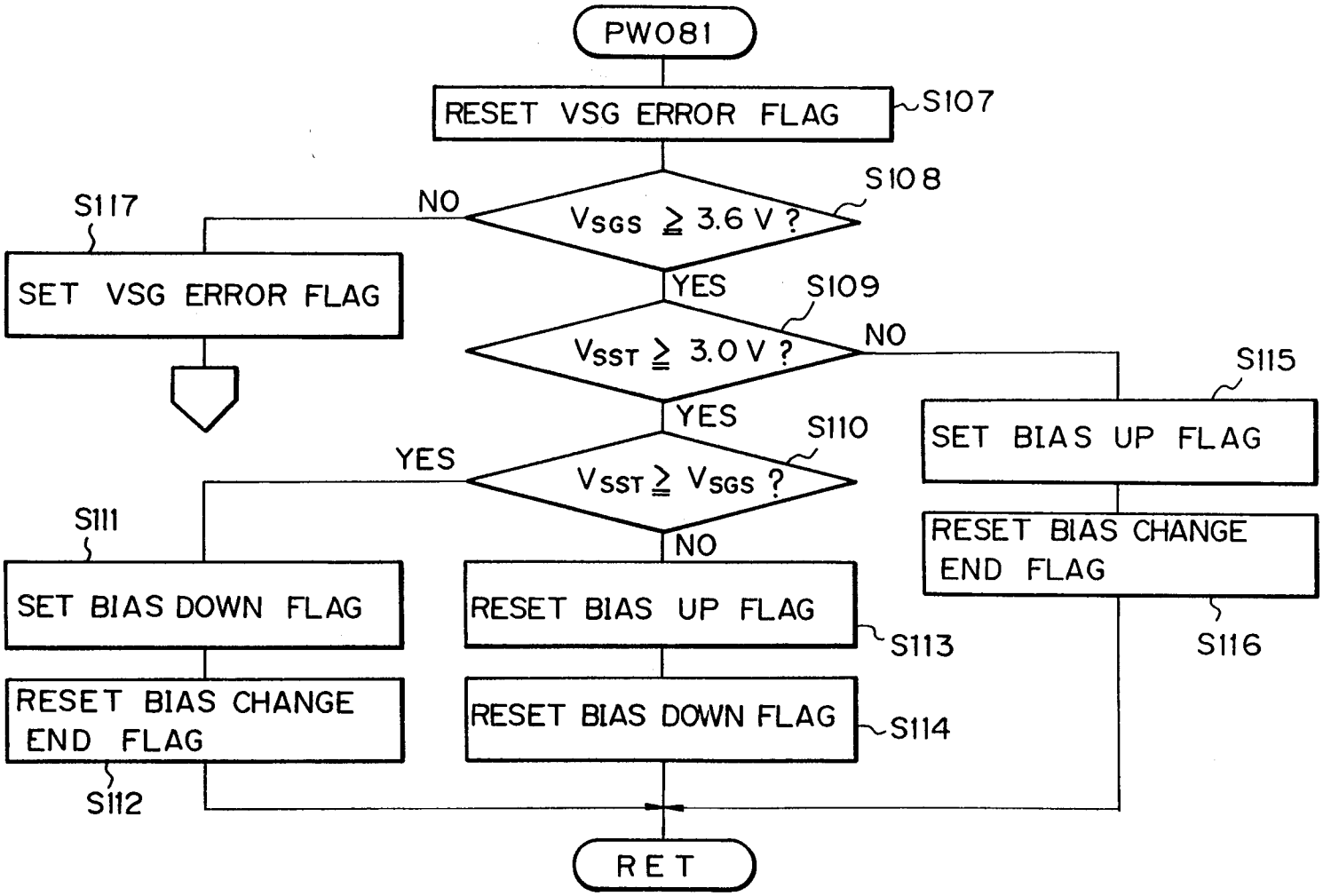

FIG. 29 shows the step S103 of FIG. 28 specifically. As shown, a VSG error flag is reset in a step S107, and whether or not VSGS has exceeded 3.6 volts is determined in a step S108. If the answer of the step S108 is YES, a step S109 is executed to see if whether VSST has exceeded 3.0 volts. If the answer of the step S109 is YES, whether or not VSST is greater than VSGS is determined in a step S110. If the answer of the step S110 is YES, a step S111 is executed to set the bias down flag. This is followed by a step S112 for resetting the bias change end flag. If the answer of the step S110 is NO, the bias up flag is reset in a step S113 while the bias flag is reset in a step S114. If the answer of the step S109 is NO, the bias up flag is set in a step S115 while the bias change end flag is reset in a step S116. If the answer of the step S108 is NO, the program advances to a step S117 for setting the VSG error flag.

FIG. 30 indicates the step S86 of FIG. 27 specifically. In a step S118, whether or not the correction end flag is set is determined. If the answer is NO, whether or not a correction value read flag is set is determined in a step S119. If the answer of the step S119 is YES, the program executes a step S120 for performing the following calculation:

$$VSCK \times \frac{VSGS}{VSGC} = VSCK'$$

The step S120 is followed by a step S121 to see if VSGC has exceeded 25 volts. If the answer of the step S121 is YES, whether or not VSCK' has exceeded 5.0 volts is determined in a step S122. If the answer of the step S122 is NO, PWO91 processing (FIG. 31) is executed in a step S123, followed by a step S124 for setting the correction end flag. If the answer of the step S121 is NO and the answer of the step S122 is YES, a step S125 is executed to set a comparison value error flag.

Figure 31:
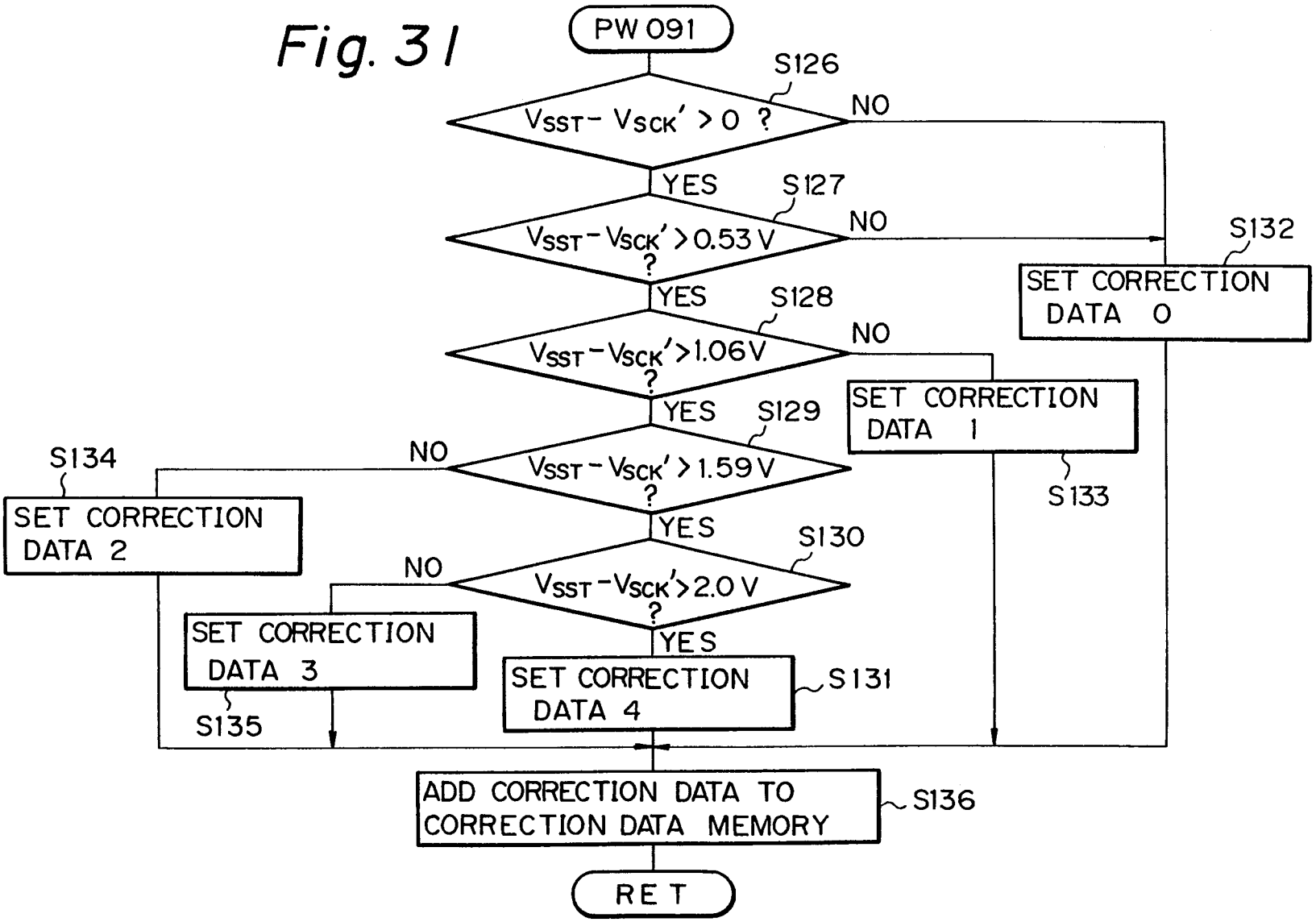

FIG. 31 shows the step S123 of FIG. 30 specifically. In a step S126, whether (VSST−VSCK') is greater than zero is determined. If the answer is YES, whether (VSST−VSCK′) is greater than 0.52 volt is determined in a step S127. If the answer of the step S127 is YES, whether (VSST−VSCK′) is greater than 1.06 volts is determined in a step S128. If the answer of the step S128 is YES, whether or not (VSST−VSCK′) is greater than 1.59 volts is determined in a step S129. If the answer of the step S129 is YES, a step S130 is executed to see if (VSST−VSCK′) is greater than 2.0 volts. If the answer of the step S130 is YES, the fourth correction data is produced in a step S131. If the answers of the steps S126 and 127 are NO, the zeroth correction data is produced in a step S132. If the answer of the step S128 is NO, the first correction data is produced in a step S133. If the answer of the step S129 is NO, the second correction data is produced in a step S134. Further, if the answer of the step S130 is NO, the third correction data is produced in a step S135. In a step S136, the correction data produced by the above procedure is added to a bias voltage for an ordinary copying operation.

Figures 32, 32A:
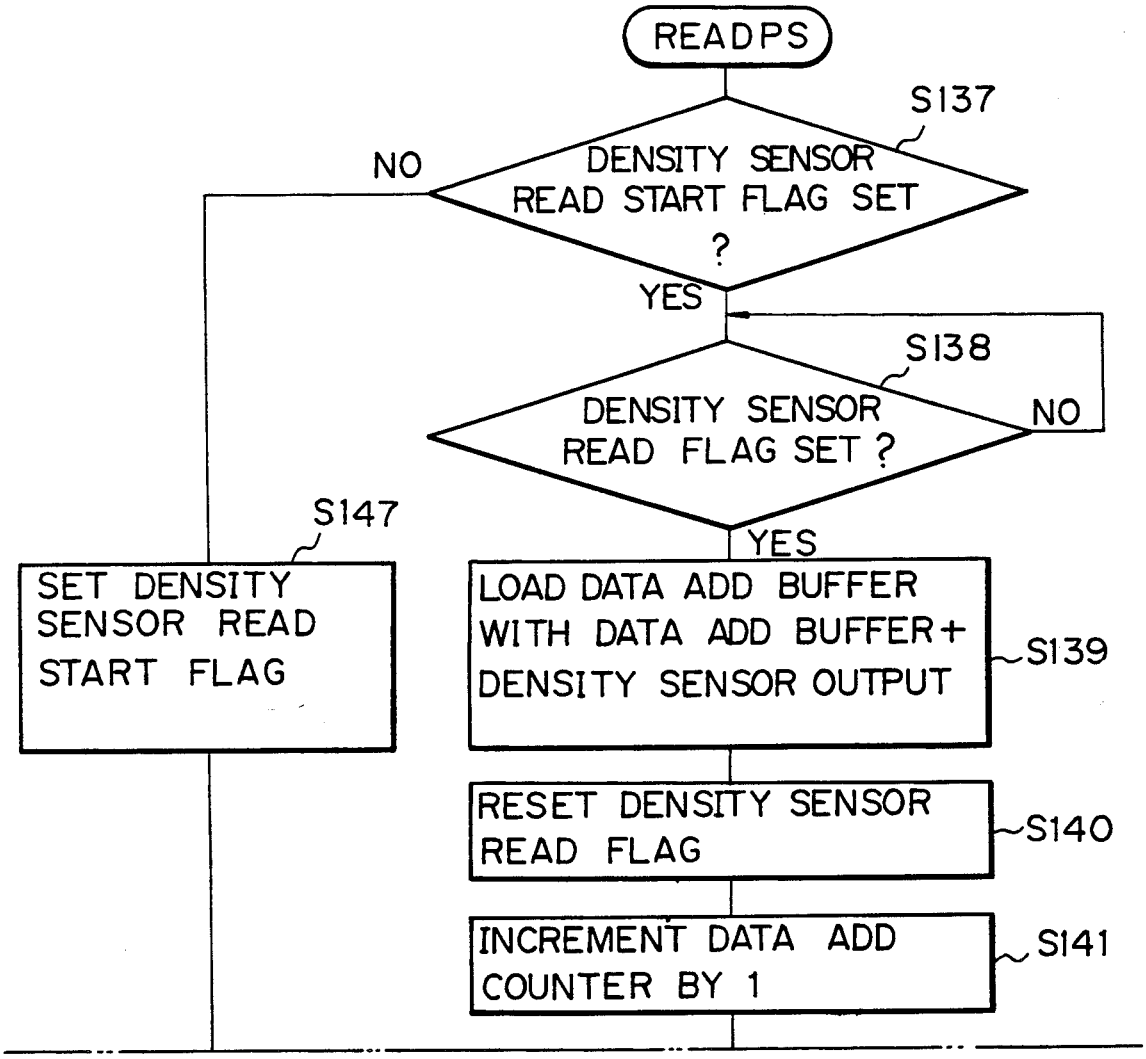
Figure 32B:
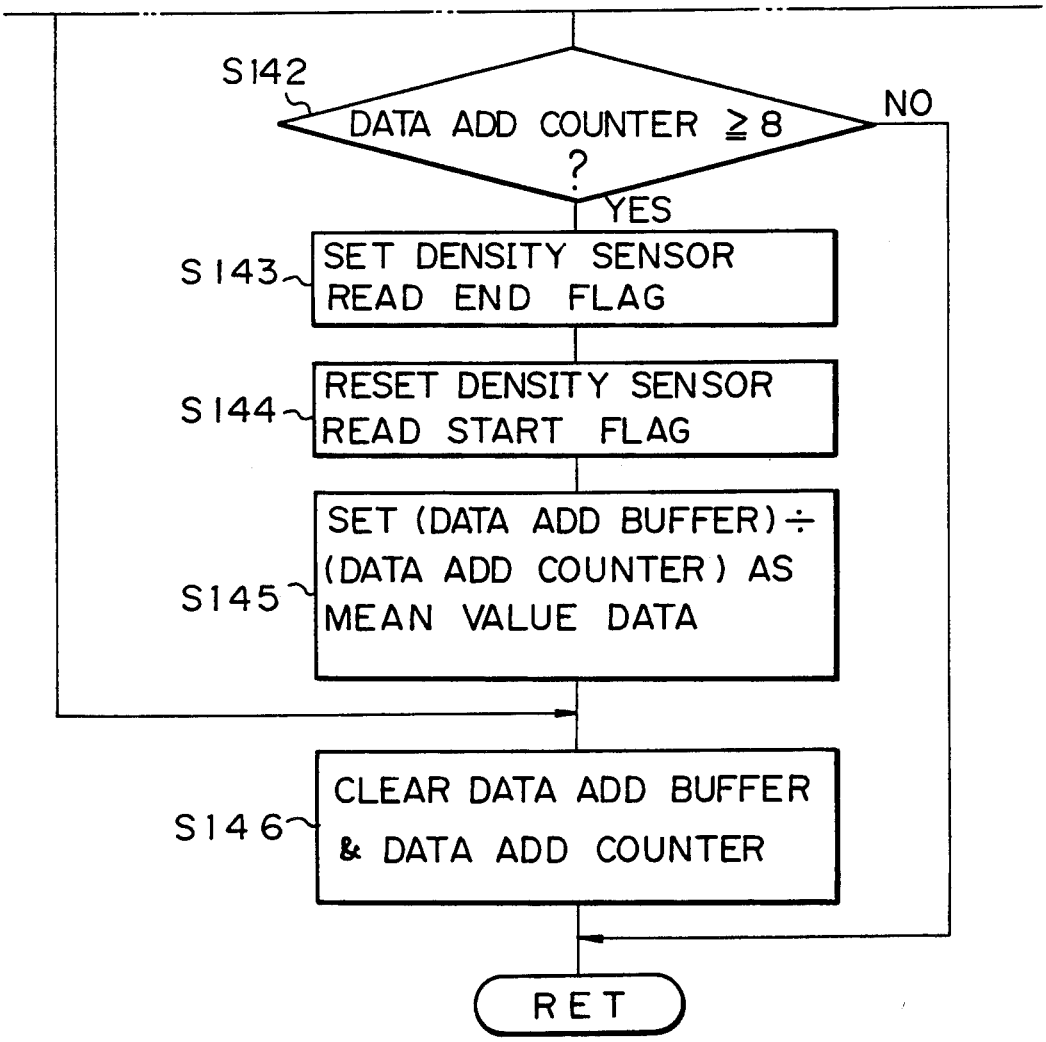

FIG. 32 demonstrates output data read processing. When a density sensor read start flag is set as decided in a step S137, a step S138 is executed to see if a density sensor read flag is set. If the answer of the step S138 is YES, density sensor output is added to a data add buffer in a step S139. In a step S140, the density sensor read flag is reset. In a step S141, a data add counter is incremented. When the data add counter has exceeded "8" as determined in a step S142, a step S143 is executed to set a density sensor read end flag. In a step S144, the density sensor read start flag is reset, followed by a step S145. In the step S145, a value produced by dividing the data add buffer by the data add counter is determined to be the mean data. In a step S146, the data add buffer and data add counter are cleared. If the answer of the step S137 is NO, a step S147 is executed to set the density sensor read flag, followed by the step S146.

As stated above, in the illustrative embodiment, the bias voltage for development is corrected on the basis of a density output VSGC associated with the background of a drum and representative of the fatigue of the drum, a density output VSCK associated with a white reference pattern image, and their reference values. At the same time, the toner supply is controlled on the basis of the density output VSGC, as stated with reference to FIG. 6.

The embodiment shown and described achieves various unprecedented advantages, as follows. Since state detecting means determines whether or not a bias voltage correction is necessary and allows it to be executed only if it is necessary, wasteful power consumption and decrease in the life of parts are eliminated. The correction is extremely accurate because it is based on a density output associated with the background of a drum and accurately representative of the fatigue of the drum and a density output associated with a white reference pattern image.

While the illustrative embodiment has concentrated on a bias voltage for development, the present invention is practicable with any other kind of image forming factor to be corrected, e.g. an amount of charge or an amount of exposure.

In summary, it will be seen that the present invention provides an image forming apparatus which is efficiently operable because an image forming factor is corrected only when necessary, as determined by means which is responsive to an inactive state of the apparatus. The correction is accurate because it is performed on the basis of an output of density sensing means which is responsive to the density of a reference density sensing portion of a photoconductive element which is an exact representation of the fatigue of the apparatus.

Various modifications will become possible for those skilled in the art after receiving the teachings of the present disclosure without departing from the scope thereof.

What is claimed is:

1. An image forming apparatus having an image carrier for carrying a latent image, comprising:

state sensing means for sensing the duration of an inactive state of the image carrier;

density sensing means for sensing a density of a predetermined density sensing portion of the image carrier; and control means for correcting an image forming factor in response to an output signal of said state sensing means and an output signal of said density sensing means which are representative of a sensed inactive state and a sensed density, respectively.

2. An image forming apparatus as claimed in claim 1, wherein said state sensing means comprises a first and a second thermistor which are associated with the image carrier and an image fixing unit, respectively.

3. An image forming apparatus as claimed in claim 1, wherein said density sensing means comprises a density sensor constituted by a light emitting element and a light-sensitive element.

4. An image forming apparatus as claimed in claim 1, wherein said image forming factor comprises a bias voltage for development.

5. An image forming apparatus as claimed in claim 1, wherein said image forming factor comprises an amount of charge to be deposited by a charger.

6. An image forming apparatus as claimed in claim 1, wherein said image forming factor comprises an amount of exposure to be performed by imagewise exposing means.

* * * * *